US005593028A

United States Patent [19]

Haber et al.

[11] Patent Number: 5,593,028

[45] Date of Patent: *Jan. 14, 1997

[54] MULTI-PHARMACEUTICAL STORAGE, MIXING AND DISPENSING VIAL

[75] Inventors: Terry M. Haber, Lake Forest; William H. Smedley, Lake Elsinore; Clark B. Foster, Laguna Niguel, all of Calif.

[73] Assignee: Habley Medical Technology Corporation, Laguna Hills, Calif.

[ * ] Notice: The term of this patent shall not extend beyond the expiration date of Pat. No. 5,335,773.

[21] Appl. No.: 108,458

[22] Filed: Aug. 17, 1993

Related U.S. Application Data

[63] Continuation-in-part of Ser. No. 97,300, Jul. 26, 1993, abandoned, and a continuation-in-part of Ser. No. 89,980, Jul. 9, 1993, abandoned, and a continuation-in-part of Ser. No. 87,152, Jul. 2, 1993, Pat. No. 5,335,773.

[51] Int. Cl.[6] ..... B65D 25/08

[52] U.S. Cl. ..... 206/221; 206/219; 215/DIG. 8; 604/203

[58] Field of Search ..... 206/63.5, 219, 206/221; 215/DIG. 8; 220/270, 375

[56] References Cited

U.S. PATENT DOCUMENTS

| | | | |
|---|---|---|---|
| 2,764,156 | 9/1956 | Simon et al. . | |
| 2,764,157 | 9/1956 | Oliva et al. . | |
| 2,773,591 | 12/1956 | Jensen | 206/221 |
| 2,813,649 | 11/1957 | Lipari | 215/DIG. 8 |
| 3,139,180 | 6/1964 | Kobernick . | |
| 3,139,181 | 6/1964 | Kobernick . | |
| 3,156,369 | 11/1964 | Bowes et al. . | |
| 3,163,163 | 12/1964 | Wilburn . | |
| 3,198,194 | 8/1965 | Wilburn . | |
| 3,321,097 | 5/1967 | Solowey | 206/221 |
| 3,464,414 | 9/1969 | Sponnoble . | |
| 3,539,794 | 11/1970 | Rauhut et al. . | |
| 3,779,371 | 12/1973 | Rovinski . | |
| 3,842,836 | 10/1974 | Ogle . | |
| 3,874,570 | 4/1975 | Katzman et al. | 220/375 |
| 4,315,570 | 2/1982 | Silver et al. . | |
| 4,550,825 | 11/1985 | Sutryn et al. | 206/221 |
| 4,727,985 | 3/1988 | McNeirney et al. | 206/221 |
| 4,886,175 | 12/1989 | Schlaudecker | 220/270 |
| 4,934,556 | 6/1990 | Kleissendorf | 220/375 |
| 4,936,446 | 6/1990 | Lataix . | |
| 4,941,876 | 7/1990 | Meyer et al. . | |
| 5,114,411 | 5/1992 | Haber et al. . | |
| 5,143,211 | 9/1992 | Miczka et al. . | |
| 5,158,546 | 10/1992 | Haber et al. . | |
| 5,188,615 | 2/1993 | Haber et al. . | |
| 5,217,433 | 6/1993 | Bunin . | |
| 5,220,948 | 6/1993 | Haber et al. . | |
| 5,240,322 | 8/1993 | Haber et al. | 215/DIG. 8 |
| 5,330,048 | 7/1994 | Haber et al. | 215/DIG. 8 |

*Primary Examiner*—David T. Fidei
*Attorney, Agent, or Firm*—Townsend and Townsend and Crew LLP

[57] ABSTRACT

A pharmaceutical storage, mixing and dispensing vial (2, 3, 202, 250) is used to store first and second pharmaceuticals (58, 60), mix the pharmaceuticals, and then provide access to the mixed pharmaceutical (102) via a needle canula. The vial includes a container (12, 112) having an open end (14) covered by a convex septum (44, 140). A barrier (37, 204) within the container interior divides the interior into first and second interior regions (54, 56) housing the pharmaceuticals. The barrier has a plug (34, 206, 252) sealing a hole (30, 264), the plug having an extension (36, 208/210) extending to the septum. The plug is driven from the opening by the plug extension when the septum is deflected into the container interior. The septum then naturally returns to its undeflected state to eliminate pressurization of the container interior.

35 Claims, 19 Drawing Sheets

MULTI-PHARMACEUTICAL STORAGE, MIXING AND DISPENSING VIAL

This application is a continuation-in-part of application Ser. No. 08/097,300 filed Jul. 26, 1993 , now abandoned and application Ser. No. 08/089,980 filed Jul. 9, 1993, now abandoned and application Ser. No. 08/087,152 filed Jul. 2, 1993, now U.S. Pat. No. 5,335,773 all three having the same title as this application, the disclosures of which are incorporated by reference. This application is also related to the following patents: U.S. Pat. No. 5,188,615 issued Feb. 23, 1993 for MIXING VIAL and U.S. Pat. No. 5,158,546 issued Oct. 27, 1992 for CONTROLLED ACTION SELF-MIXING VIAL, the disclosures of each being incorporated by reference.

BACKGROUND OF THE INVENTION

Safe and effective drug therapy by injection depends not only upon accurate diagnosis, but also on efficient and reliable introduction of the medical substance into the subcutaneous cellular tissue without introducing contaminants or ambient air. The applicable drug or pharmaceutical must first be drawn from the resident container or vial into a syringe before injection. The integrity and features of the vial, therefore, are influential over the overall safety of the injection.

Problems associated with injections are complicated when the medication to be administered must be stored as two separate component parts, then mixed, prior to injection. Dual chamber vials have been developed to facilitate storage and mixing of these two-component medications. Common examples of multipart medications include medications which must be mixed from a component A, usually a preservative or catalyst, and a component B, which is usually a pharmaceutical. Component A or component B may be in powder or crystalline form instead of liquid form.

Dual chamber vials have been developed which allow an A component and a B component to remain separated in independent chambers within a single package until mixing is desired. The vial allows mixing of the component parts in that same unitary package. In an example of such a device is the MIX-O-VIAL two compartment vial manufactured by the Upjohn Company of Kalamazoo, Mich. This device is a single vial container having two chambers separated by a small stopper. The septum is formed by a stopper-piston slidably mounted within the vial at one end. The stopper-piston is forced into the vial to pressurize the chamber between the stopper-piston and the plug doing so displaces a plug lodged in a small orifice separating the two chambers. The displaced plug floats freely in the other chamber and is used as an agitator to mix the two component parts together. The two components are free to flow between chambers through the connecting orifice and thereby mix together. Although this device has proven quite useful, it has its disadvantages.

While in many cases having an over-pressure (as is produced in the MIX-O-VIAL) existing within a vial is not a problem, if the pharmaceuticals are in the form of cytotoxins used for chemotherapy, over-pressure within the vial could create safety problems. It is quite possible that upon accessing the vial, a quantity of the cytotoxin could be accidentally released onto the skin of a health care worker. Cytotoxins are quite dangerous in this concentrated form and are capable of destroying tissue they come in contact with.

Pharmaceutical components are sometimes sensitive to how violently they are mixed. For example, certain lyophilized crystals of human growth hormone, when mixed with a liquid carrier, must be mixed slowly. Mixing too quickly can cause damage to the pharmaceutical. The mechanical crushing, shearing and tearing which can accompany rapid mixing caused by a loose solid agitator, can break up the molecules into subcomponents which do not retain the same medical qualities.

SUMMARY OF THE INVENTION

The present invention is directed to a pharmaceutical vial used to store first and second pharmaceutical components in separate regions, mix the pharmaceutical components and withdraw the mixed pharmaceutical through a needle canula. The invention is simple in construction and is designed so that the mixed pharmaceutical is not subjected to an over-pressure within the interior of the container when accessed by the needle cannula to effectively eliminate the problems associated with having a pharmaceutical-containing vial at an over-pressure.

The vial includes a container having an open end, a needle pierceable access member, preferably in the form of a convex septum, which covers the open end of the container to create a sealed interior therein. A barrier is fixed in place within the interior of the container and divides the interior into first and second interior regions housing the first and second pharmaceutical components. The barrier is capable of being breached when at least a portion of the access member is driven into the container interior. This breaching preferably occurs by shifting a plug in the barrier thus providing fluid access between the interior regions. The plug is preferably mechanically driven, from its sealed position to its open position, by virtue of the access member pushing on a relatively rigid extension of the plug. If desired, the plug and its mating hole in the barrier can include mating ridge and groove portions to help ensure the plug does not inadvertently become dislodged from the hole and to help provide a fluid-tight seal between the plug and the remainder of the barrier.

There are two main aspects to the invention. With the first aspect, the access member is secured to the open end of the container so that the access member can enter the container interior but does not slide within the container. The access member is designed so that after being forced into the container interior, the access member returns to its original position so to eliminate any overpressure in the container. The access member is preferably in the form of a resilient, outwardly bowed or convex septum; it could have another shape, such as flat, as well.

A second aspect of the invention relates to the use of a movable access member, which can either be a septum, as with the first type, or a piston, but which is mechanically (as opposed to pneumatically or hydraulically) coupled to the barrier so that the movement of the access member, as opposed to increased pressure in the vial interior, causes the barrier to be breached.

One of the advantages of the invention is that by using an access member, typically a septum, which returns to its original, pre-deflected state after being deflected causing the barrier to breached, pressurization within the container interior when accessed by a needle cannula is eliminated. This is very important in dealing with cytotoxins as the mixed pharmaceutical.

Another feature of the invention is the provision of a protective cap used to cover the septum until mixing has taken place. After mixing the pharmaceutical components, the cap automatically pops open, thus exposing the septum. This not only helps protect the septum from contamination, it also prevents premature access to the interior of the container. This is important to prevent access to the contents before mixing so to prevent the unintended or unauthorized introduction of a foreign substance into the vial or removal of some of the contents from the vial prior to mixing.

A further feature of the invention relates to the promotion of effective but gentle mixing of the pharmaceutical components. This is achieved by the careful sizing and configuration of the opening between the two interior regions of the interior of the container. The proper sizing and configuration of the opening created by the displaced plug, for a particular viscosity of the liquid pharmaceutical component, causes a bubbling or glugging effect as the liquid flows from one interior region into the other interior region.

Other features and advantages of the invention will appear from the following description in which the preferred embodiment has been set forth in detail in conjunction with the accompanying drawings.

DETAILED DESCRIPTION OF THE INVENTION

Figure 1:
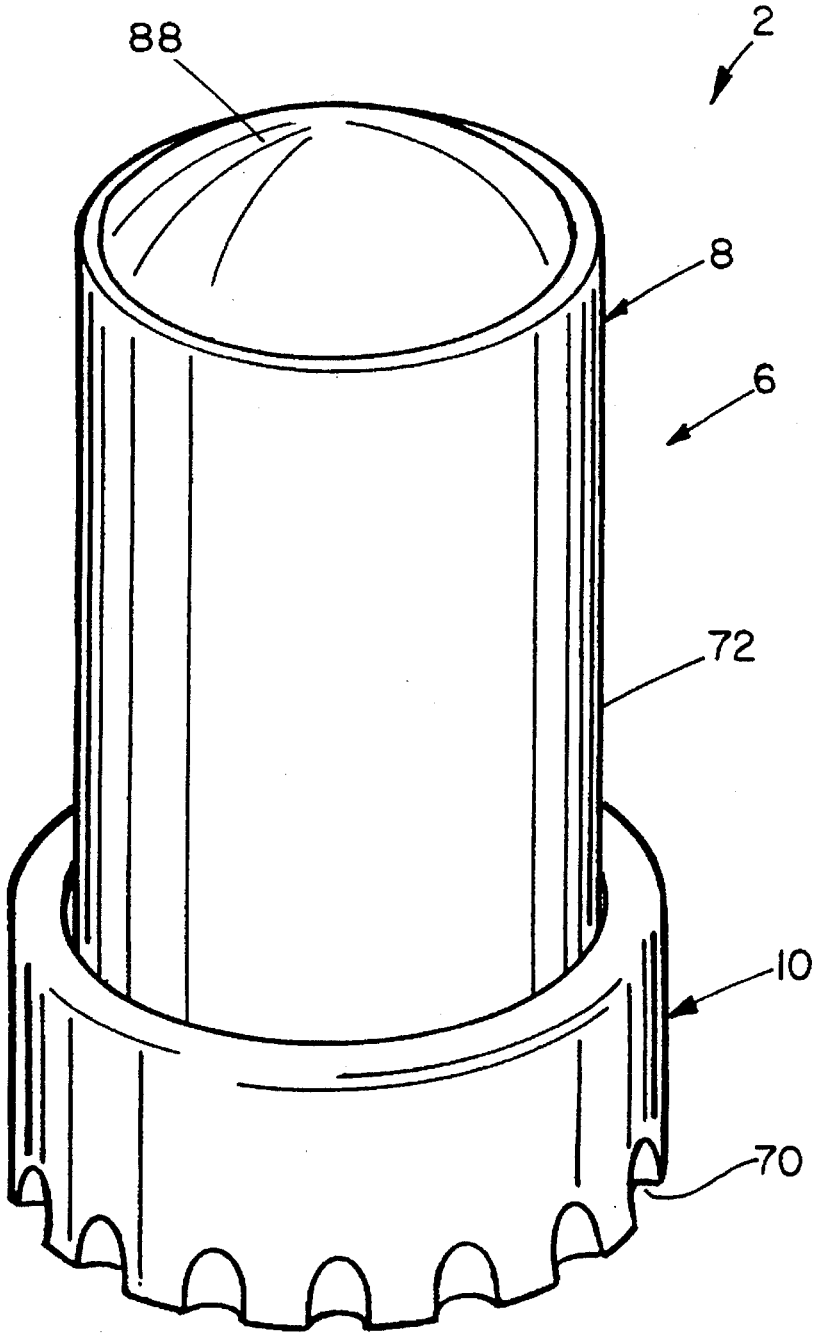
FIG. 1 is an isometric view of a vial made according to the invention.
Figure 2:
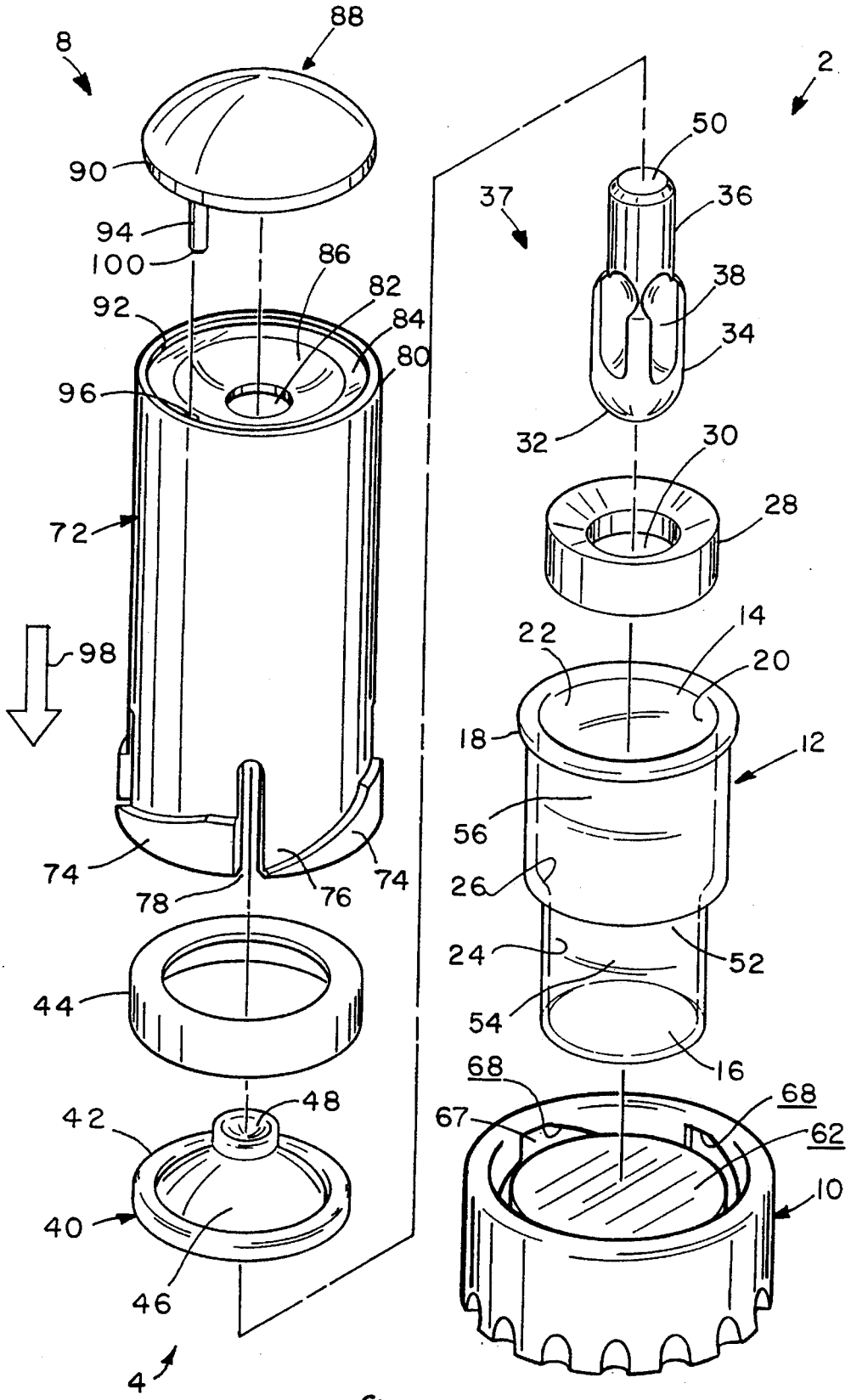
FIG. 2 is an exploded isometric view of the vial of FIG. 1.
Figure 3:
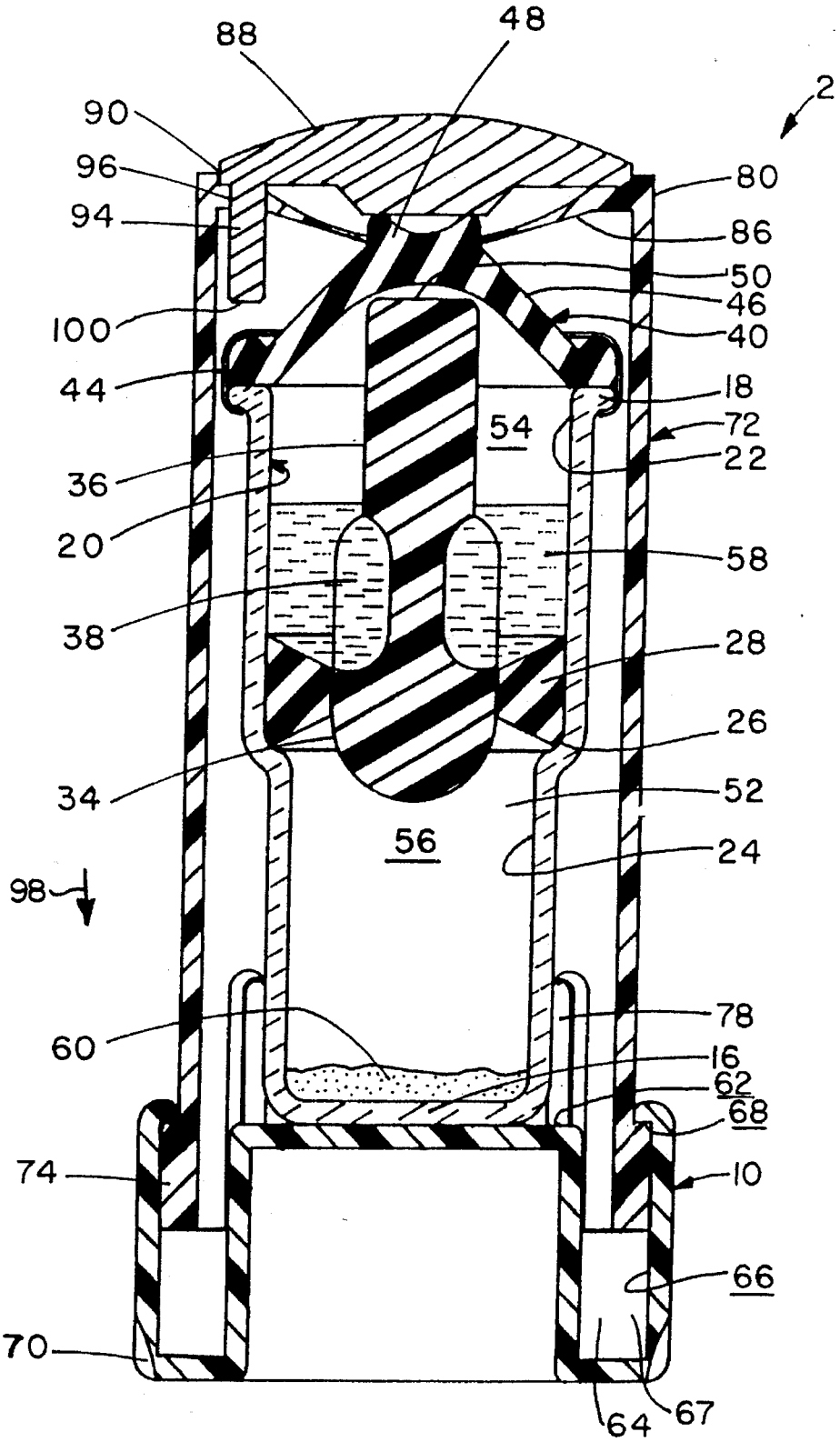
FIG. 3 is a cross-sectional view of the vial of FIG. 1 shown in the pre-use condition.

FIGS. 1–3 illustrate a multi-pharmaceutical storage, mixing and dispensing vial 2 including a container assembly 4 housed within a housing 6. Housing 6 includes a generally cylindrical, hollow cap assembly 8 rotatably mounted to a base 10.

Container assembly 4 includes a cup-shaped container 12, preferably made of glass, having an open end 14 and a closed end 16. Open end 14 has a lip 18. Container 12 has an inner wall 20 defining an upper cylindrical wall portion 22 and a lower cylindrical wall portion 24. Wall portion 22 is a somewhat larger diameter than wall portion 24, the two wall portions being joined at a ledge 26. An elastomeric seal ring 28 is positioned snugly against upper cylindrical wall portion adjacent ledge 26. Seal ring 28 is made from a pharmaceutical compatible material, such as 50 Durometer silicone rubber. Elastomeric seal ring 28 has a central hole 30 in which the distal end 32 and of a plug 34 is lodged.

In the as-shipped, pre-use condition of FIGS. 1 and 3, plug 34 and seal ring 28 act as a fluid seal or barrier 37 in container 12. Fluid passage through hole 30 is provided by pushing on an extension 36 of plug 34 so to overlap axial slots 38 with hole 30. In this position, plug 34 is still retained within seal ring 28, but fluid passage through hole 30 is achieved. Plug 34/extension 36 is made form a lubricous material, to minimize friction within hole 30, such as PTFE. This movement of plug extension 36 and plug 34 is discussed below.

Container assembly 4 also includes an elastomeric convex septum 40 having a periphery 42 that engages open end 14 and around lip 18 of container 12. Septum 42 is made from a pharmaceutical compatible material, such as 60 Durometer silicone rubber. Septum 42 is secured in place by a metal, preferably aluminum, retaining band 44. Septum 40 has a convex central portion 46 and a needle-pierceable region 48 at the center of central portion 46. Portion 48 is slightly dished to help in the insertion of a needle cannula, not shown, through septum 40 at portion 48.

Septum 40 and inner wall 20 define a sealed interior 52 of container assembly 4. Barrier 37 separates sealed interior 52 into a first or upper interior region 54 between septum 40 and barrier 37 and a second or lower interior region 56 defined between barrier 37 and closed end 16 of container 12. First and second pharmaceutical components 58, 60 are housed within first and second interior regions 54, 56, respectively. In the disclosed embodiment, first pharmaceutical component is a liquid and second pharmaceutical component is dry. However, both pharmaceutical components could be liquids, the dry pharmaceutical component could be a slurry and the locations of the liquid and dry pharmaceutical components in the first and second housings could be reversed.

Dry pharmaceutical component 60 is an lyophilized pharmaceutical component. Container 12 could be used to create the lyophilized component. This is done by adding an appropriate amount of a liquid or slurry pharmaceutical component used to create second, dry component 60. The container 12 is then placed in the lyophilization oven and the volatile components are driven off until a suitably dried second pharmaceutical component 60 is achieved. Container assembly 4 can then be assembled, adding first pharmaceutical component 58 to first interior region 54 after installing barrier 37 and just prior to sealing open end 14 with septum 40 and retaining band 44.

Figure 3A:
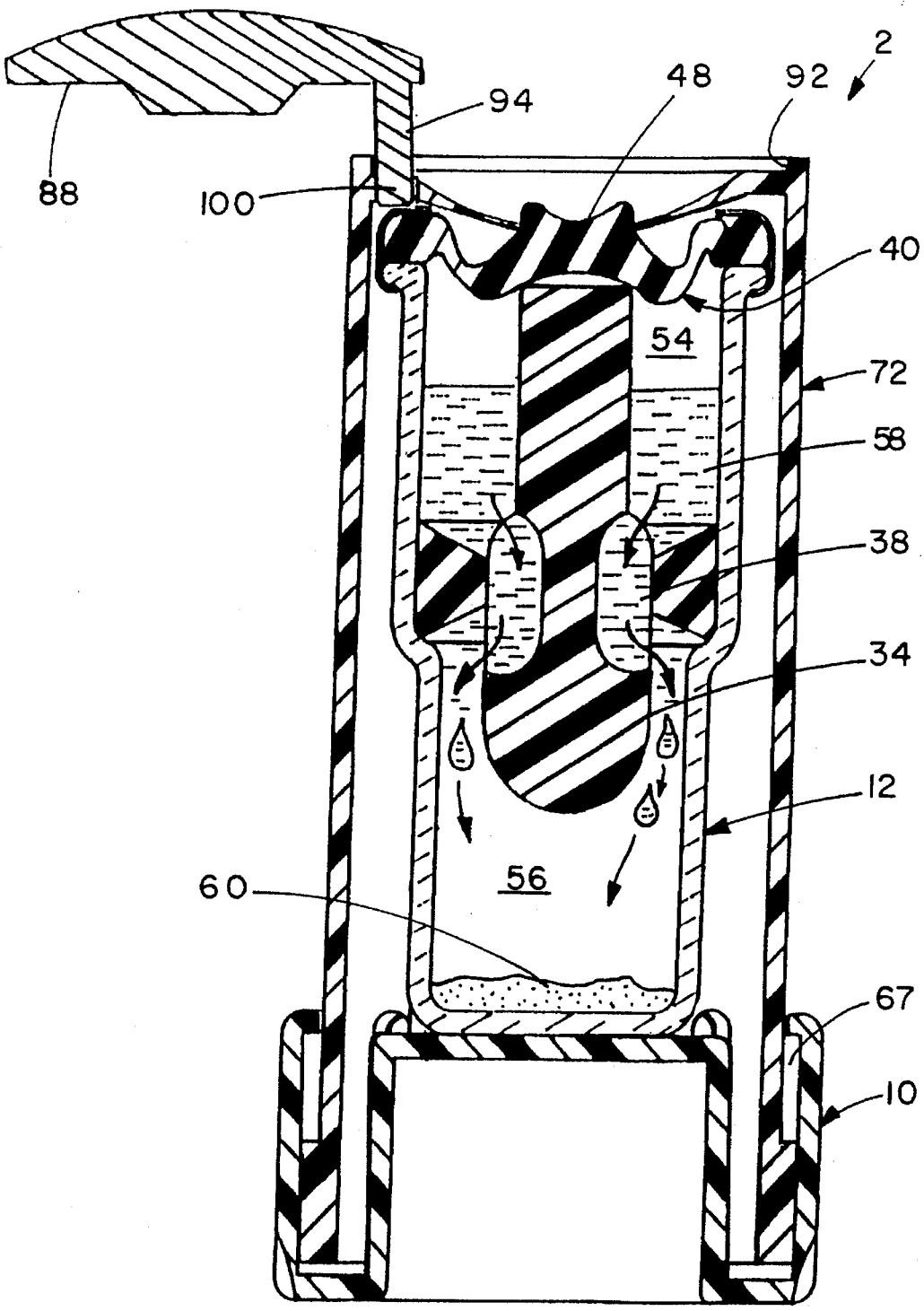
FIG. 3A is a view similar to FIG. 3 but after the housing has been collapsed to move the septum to its second, deflected position, the needle cannula shield has been pivoted to expose the needle pierceable portion of the septum and the plug has been moved to its unsealed position to permit the pharmaceutical components to mix.

A user could, if desired, dislodge plug 34 from hole 30 by simply pressing on needle-pierceable portion 48 of septum 40. This would drive plug extension 36 and thus plug 34 away from convex septum 40 until axial slots 38 are aligned with hole 30. This alignment, as shown in FIG. 3A, permits the liquid first pharmaceutical component 58 to flow into second interior region 56 and mix with second pharmaceutical component 60. Due in part to the natural resilience of septum 40, septum 40 returns to its normal, convex shape, see FIG. 3B, once released by the user. Once components 58, 60 are suitably mixed, user can then invert container assembly 4 and access the interior 52 using a needle cannula of a syringe to pierce portion 48 of septum 40 in a conventional manner. Since septum 40 returns to its pre-use condition, an overpressure within sealed interior 52 is eliminated.

Housing 6 is used for several purposes. It provides a physical protection to container 12, helping to protect the container against physical damage. Housing 6 also covers and thus provides a needle cannula shield to prevent the premature access by a needle cannula into sealed interior 52 prior to mixing. Housing 6 also provides a mechanical advantage for the user in driving plug 34 partly through hole 30 of seal ring 28.

Base 10, typically polycarbonate, includes a support surface 62 against which closed end 16 of container 12 rests. Support surface 62 is surrounded by an annular space 64. An outer surface 66 of base 10 partly defines annular space 64. Surface 66 has a number of openings 67 partly bounded by cam ramped surfaces 68 formed in outer surface 66 and used for purposes described below. Base 10 also has numerous cut-outs 70 along its lower edge to enhance gripping by the user.

Cap assembly 8 includes a generally cylindrical upper housing 72, also typically made of polycarbonate, having externally extending ramped camming lugs 74 configured to fit within openings 67 in outer surface 66. A number of axially extending slots 78 are formed at lower end 76 of housing 72 to facilitate assembly. Slots 78 permit lower end 76 to be deflected inwardly when inserting lower end 76 into annular space 64 and then permit segments of the lower end defined between slots 78 to spring outwardly with ramped camming lug 74 engaged within openings 67 formed in surface 66.

The upper end 80 of upper housing 72 is closed except for a central opening 82 sized and positioned to accept needle pierceable portion 48 of septum 40. Upper end 80 includes a ledge 84 and a slightly concave portion 86 within which central opening 82 is formed. Cap assembly 8 also includes a needle cannula shield 88 which is made of a material resistant to puncture by a needle cannula, typically aluminum. Shield 88 has a periphery 90 sized to fit snugly, but not with a force fit, against a circumferential shoulder 92 adjacent ledge 84.

Shield 88 includes a pin 94 extending downwardly through a corresponding hole 96 in ledge 84. Twisting the two components of housing 6, that is cap assembly 8 and base 10, relative to one another, causes upper housing 72 to move downwardly, that is in the direction of arrow 98 in FIG. 3, relative to base 10 through the engagement of lugs 74 with ramped surfaces 68. This action forces convex central portion 46 of septum 40 in the direction of arrow 98 primarily due to the engagement of concave portion 86 of upper end 80 of upper housing 72. Such axial movement almost immediately causes portion 46 of septum 40 to engage the upper end 50 of plug extension 36, thus forcing plug 34 in the direction of arrow 98. This movement causes that portion of plug 34 containing axial slots 38 to be captured within hole 30 of ring 28, thus permitting first pharmaceutical component 58 to now drain down into and mix with second pharmaceutical component 60 through the now breached barrier 37. See FIG. 3A.

Figure 3B:
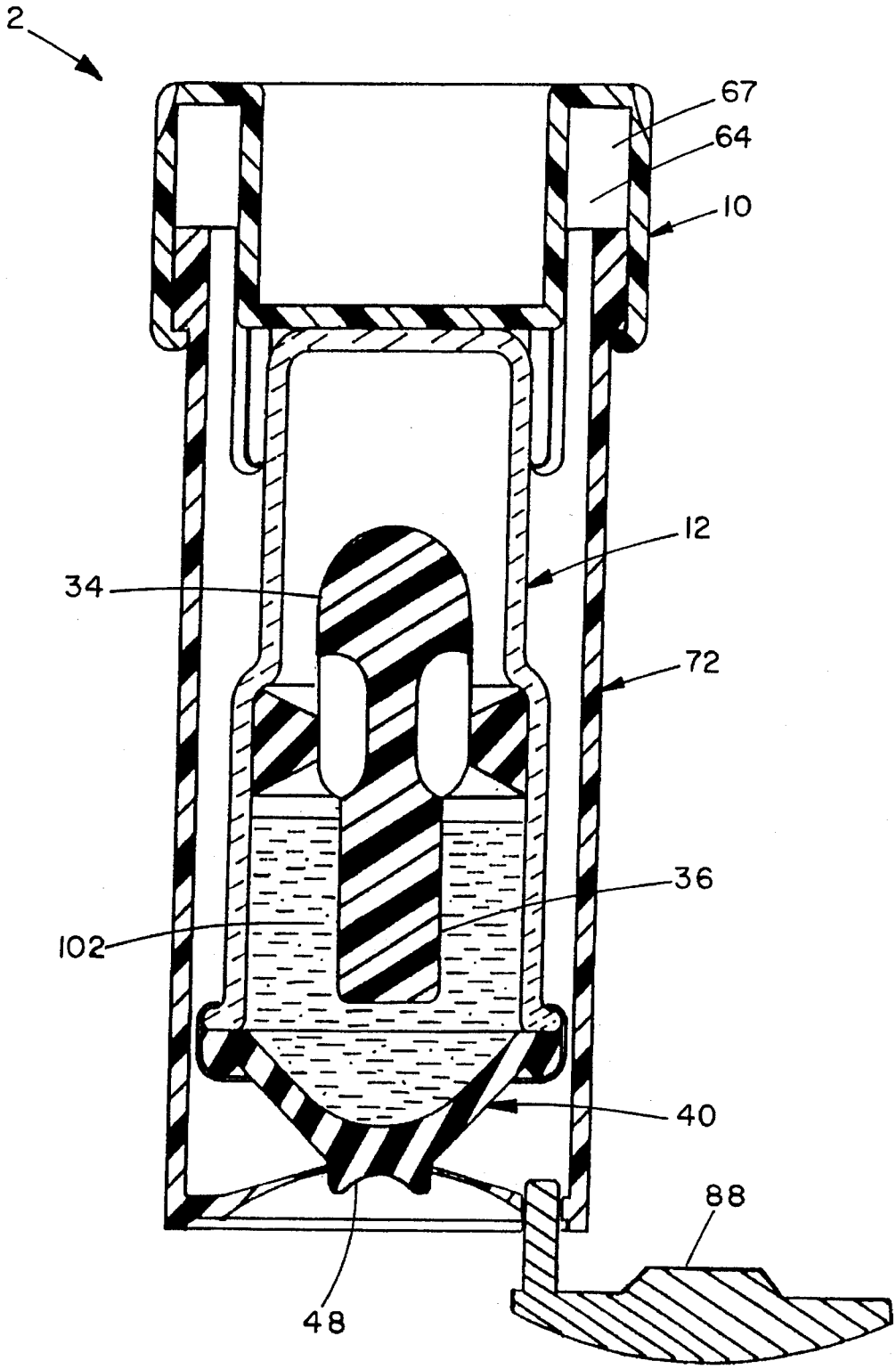
FIG. 3B is a view similar to that of FIG. 3A but inverted and with the septum returned to its first, undeflected position.

Movement of cap assembly 8 in the direction of arrow 98 also causes distal end 100 of pin 94 to engage retaining band 44 of container assembly 4, thus forcing pin 94 through hole 96. The initial movement pin 94 within hole 96 is relatively unrestricted by the pin in the hole; the pin, over most of its length, is undersized relative to the hole. However, the distal end 100 of pin 94 is slightly larger to create a snug fit of pin 94 within hole 96. Thus, as base 10 and upper housing 72 are rotated relative to one another, thus driving upper housing 72 in the direction of arrow 98 relative to base 10, while holding vial 2 at an angle to the vertical, causes shield 88 to swing out of the way, thus uncovering needle-pierceable portion 48 of septum 40 during the initial portion of the movement. At the end of the movement of upper housing 72 relative to base 10, the enlarged distal end 100 of pin 94 becomes snugly engaged within hole 96 so to maintain shield 88 in this septum-exposed position as shown in FIG. 3B.

The nesting of periphery 90 of shield 88 within an annular region defined by shoulder 92 and ledge 84 helps prevent inadvertent or premature removal of shield 88. However, after vial 2 has been activated by rotating base 10 relative to upper housing 72, portion 48 of septum 40 is very accessible for cleaning, such as by swabbing with alcohol, and for access by a needle cannula into sealed interior 52 for access to mixed pharmaceutical 102.

In use, a vial 2 is provided with first and second pharmaceutical components 58, 60 within interior regions 54, 56, such as a human growth hormone or a cytotoxin. To mix the pharmaceutical components, user rotates base 10 relative to upper housing 72 causing upper housing to move in the direction of arrow 98 relative to base 10. This forces concave portion 86 against convex central portion 46 of septum 40, thus driving plug 34 in the direction of arrow 98 and opening up fluid passageways between regions 54, 56 along slots 38. The movement of upper housing 72 towards base 10 also pops away shield 88, thus exposing needle-pierceable portion 48 of septum 40. With needle shield 88 pivoted out of the way, user can clean portion 48, invert vial 2, pass a needle cannula through portion 48 of septum 40 and withdraw the desired amount of the mixed pharmaceutical 102.

Figure 4:
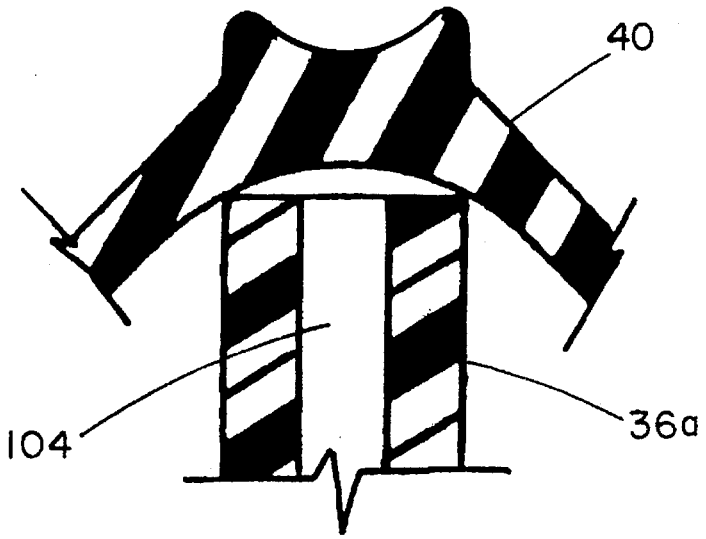
FIG. 4 is a cross-sectional view showing the hollow interior of an alternative embodiment of the plug extension of FIG. 3.

As shown in FIG. 4, plug extension **36*a* could have a hollow interior 104 and could be sized to normally rest against septum 40 when in the pre-use condition of FIGS. 1 and 3. This permits hollow interior 104 of plug extension 36*a* to house a third pharmaceutical component which would mix with the first and second pharmaceutical components 58, 60, when hole 30** is opened to create a three-component pharmaceutical.

Barrier 37 has been shown as including elastomeric seal ring 28 and plug 34. Other types of rupturable barriers can be used as well. A thin, taut elastomeric diaphragm could be used as a barrier with an axial extension of the septum extending towards the barrier with the tip of the extension positioned a short distance from the taut membrane. The tip of the septum extension could be sharpened so that, when it touches the taut membrane, the membrane ruptures providing a large opening between the two interior regions with little force and little movement. Also, a solid, brittle barrier with a notched or weakened region could be used; when the tip of a septum extension or some other mechanical coupler pushes against the brittle barrier, the barrier breaks, opening a pathway between the interior regions.

Figure 5:
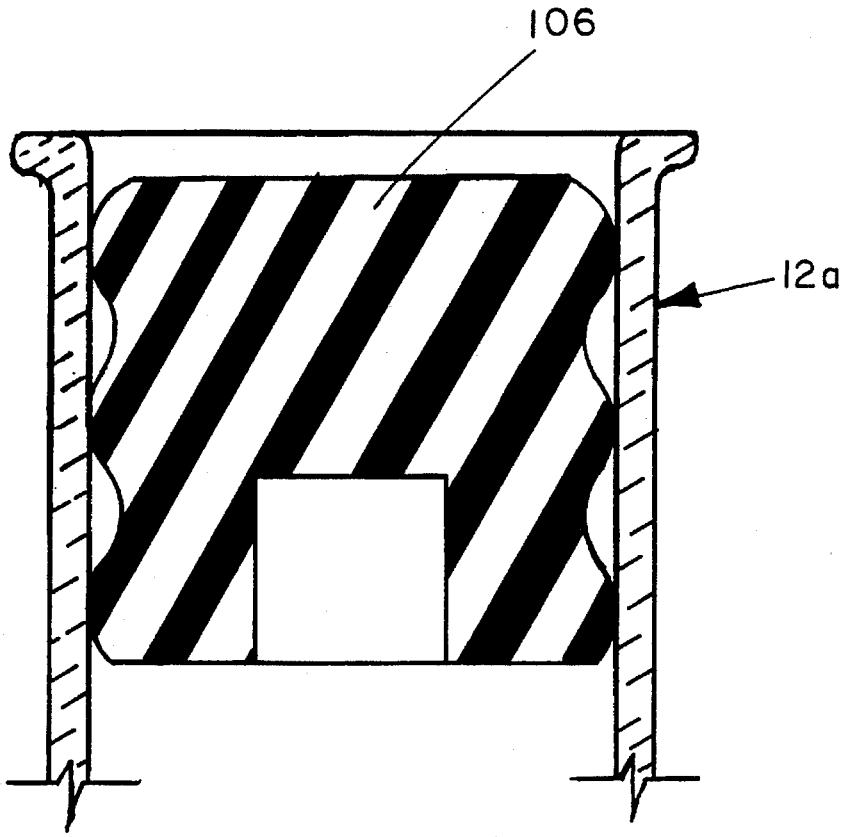
FIG. 5 is a cross-sectional view of the open end of an alternative embodiment of the container assembly of FIG. 3 using a slidable piston instead of a convex septum.

The present invention provides a significant advantage by using convex septum 40; after mixing, any overpressure in septum 52 is eliminated since the septum returns to its premixed condition. In addition the use of a convex septum which returns to its original position as illustrated in FIG. 3B causes all the mixed pharmaceutical to flow down to the lowest portion 48 of the septum 40 where it all may be captured when withdrawing the pharmaceutical with a needle. This is a particular feature and advantage of the present invention. However, the invention could be used with an axially moveable piston 106 in place of the septum. See FIG. 5. The piston would be mechanically coupled to a barrier so that only a small movement of the piston would cause the barrier to breached. Thus, rather than relying on a pneumatic pressure increase created by movement of the piston, the distance the piston must move can be minimized and still cause the rupture or other breach of the barrier so that only a small overpressure may be created. Also, in appropriate circumstances, the septum could be a flat septum which returns to its original flat configuration after the barrier has been breached. This may, however, dictate a relatively short distance of movement by the septum to create a breached barrier.

FIGS. 6–11 illustrate another multi-pharmaceutical storage, mixing and dispensing vial 3. The vial 3 includes a cup-shaped container 112, preferably made of glass, having an open end 114 and a closed end 116. Open end 114 has a lip 118. Container 112 has an inner wall 120 defining an upper cylindrical wall portion 122 and a lower cylindrical wall portion 124. Wall portion 122 is a somewhat larger diameter than wall portion 124, the two wall portions being joined at a ledge 126. An elastomeric seal ring 128 is positioned snugly against upper cylindrical wall portion adjacent ledge 126. Seal ring 128 is made from a pharmaceutical compatible material, such as 50 Durometer silicone rubber. Elastomeric seal ring 128 has a central hole 130 in which the distal end of a plug 134 is lodged.

Figure 6:
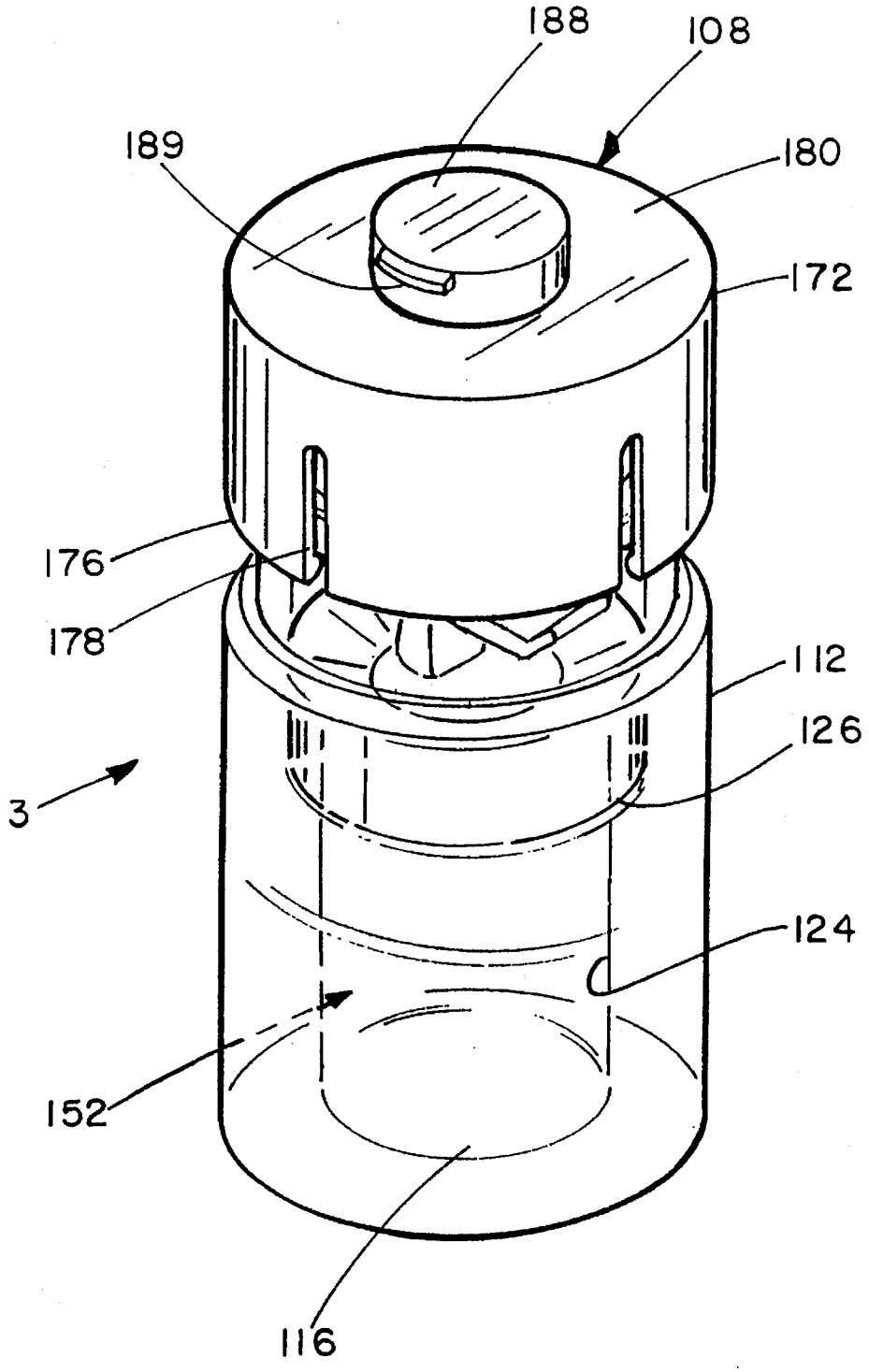
FIG. 6 is an isometric view of another vial made according to the invention.
Figure 8:
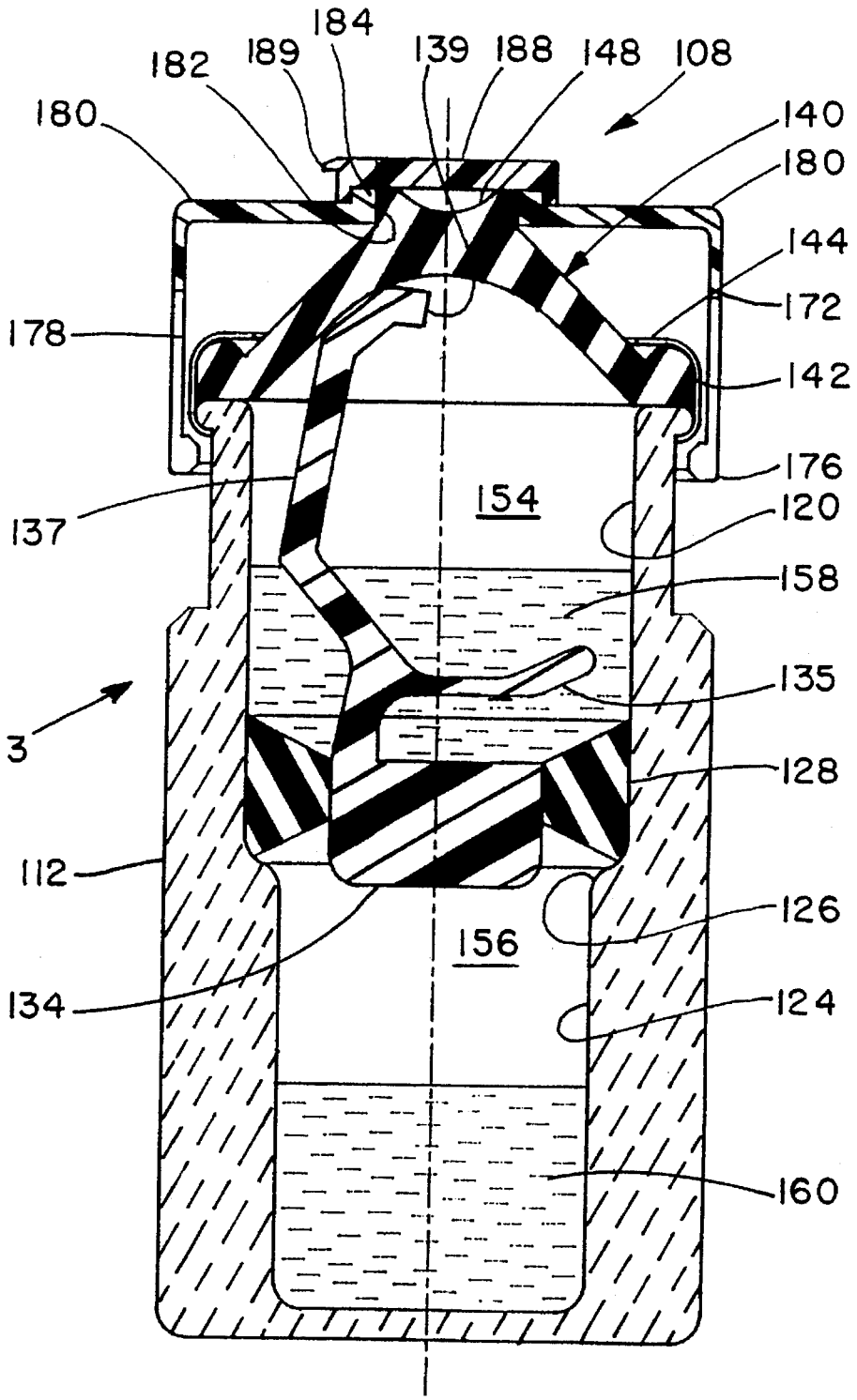
FIG. 8 is a cross-sectional view of the vial of FIG. 6 shown in the pre-use condition.

In the as-shipped, pre-use condition of FIGS. 6 and 8, plug 134 and seal ring 128 act as a fluid seal or barrier 129 in container 112. Fluid passage through hole 130 is provided by pushing on a clawlike extension 136 of plug 134 to move plug 134 out of the seal ring 128 to open a portion of hole 130. In this position, plug 134 is unseated from the seal ring 128 to form a crescent shaped fluid passage through hole 130. Plug 134/and extension 136 are made form a lubricous material such as PTFE, to minimize friction within hole 130. The movement of plug extension 136 and plug 134 is discussed below.

The vial 3 also includes an elastomeric convex septum 140 having a periphery 142 that engages open end 114 and around lip 118 of container 112. Septum 140 is made from a pharmaceutical compatible material, such as 60 Durometer silicone rubber. Septum 140 is secured in place by a metal, preferably aluminum, retaining band 144. The septum 140 has a convex central portion 146 and a needle-pierceable region 148 at the center of central portion 146. Portion 148 is slightly dished to help in the insertion of a needle cannula, not shown, through septum 140 at portion 148.

The septum 140 and inner wall 120 define a sealed interior generally indicated as 152 of vial 3. A barrier, formed by plug 134 and seal ring 128, separates the sealed interior 152 into a first or upper interior region 154 between septum 140 and the barrier and a second or lower interior region 156 defined between the barrier and the closed end 116 of container 112. First and second pharmaceutical components 158, 160 are housed within first and second interior regions 154, 156, respectively. In this disclosed embodiment, the first and second pharmaceutical components are liquids. However, one of the pharmaceutical components could be dry. Also the dry pharmaceutical component could be replaced with a slurry. The locations of the liquid and dry pharmaceutical components in the first and second housings could be reversed.

If a dry pharmaceutical component is used it could be an lyophilized pharmaceutical component. Container 112 could be used to create the lyophilized component. This is done by adding an appropriate amount of a liquid or slurry pharmaceutical component used to create the dry component. The container 112 is then placed in the lyophilization oven and the volatile components are driven off until a suitably dried pharmaceutical component is achieved. Container assembly 3 can then be assembled, adding a liquid pharmaceutical component 158 to first interior region 154 after installing the barrier and just prior to sealing open end 114 with septum 140 and retaining band 144.

A cap assembly generally indicated as 108 includes a substantially cylindrical upper housing 172, typically made of polycarbonate. A number of axially extending slots 178 are formed in the lower end 176 to facilitate assembly. The upper end 180 of the upper housing 172 is closed except for a central opening 182 sized and positioned to accept needle pierceable portion 148 of septum 140. The upper end 180 includes a centrally located annular flange 184. A needle cannula shield 188 made from a material, typically aluminum, resistant to puncture by a needle cannula, is adapted to be snapped over the annular flange 184. Tabs 189 are provided for use in removing the shield 188 from the upper housing 172 when it is desired to insert a needle to remove pharmaceutical from the vial 3.

The clawlike extension 136 which is connected to plug 134 includes a resilient flipper portion 135 at its lower end. The upper portion 137 of the extension 136 is shaped to contact the septum 140 when the vial 3 is in the shipping mode as illustrated in FIG. 8. The end 139 of the upper portion preferably terminates before the centerline of vial 3.

Figure 9:
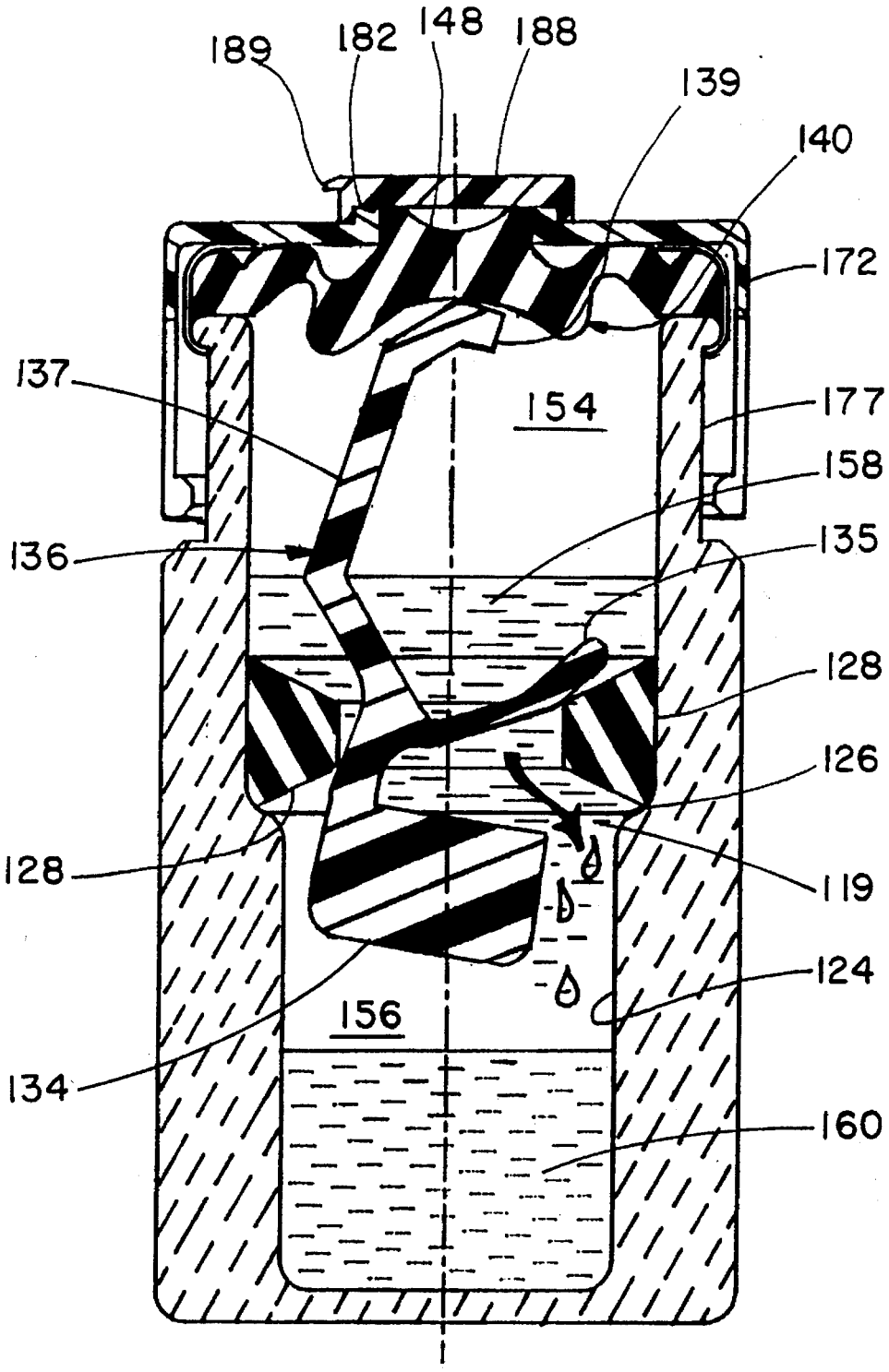
FIG. 9 is a view similar to FIG. 8 but after the housing has been collapsed to move the septum to its second, deflected position, the plug has been moved to its unsealed position to permit the pharmaceutical components to mix.

FIG. 9 illustrates the vial 3 in the mixing mode. The upper housing 172 has been depressed down the reduced outer diameter portion 177 of the container 112 by the user. The end 139 of the upper portion 137 of the clawlike extension 136 is pushed down causing plug 134 to move downward and outwardly from one side of the elastomeric seal ring 128 to form a crescent shaped opening 119 in the central hole. The upper portion 137 of the extension 136 must be stiff enough to cause the plug 134 to unseat from the seal ring 128 in the manner illustrated. The resilient flipper 135 engages on the seal ring 128 and resiliently deflects as the pharmaceuticals mix.

The plug 134, the seal ring 128 and the extension 136 are preferably sized and proportioned to provide a crescent shaped opening 119 when the upper housing 172 is depressed. When properly sized according to the viscosity of the liquid pharmaceutical which is to flow through the opening, a bubbling or glugging effect will occur as the liquid flows, thus increasing the effectiveness of the mixing occurring within the container 112. Typically a gap at the largest portion of the crescent shaped opening should be between 1.5 and 2.0 mm (0.060 and 0.080 inch). The gap should be sized so that surface tension of the liquid flowing therethrough will cause a glugging effect.

Figure 10:
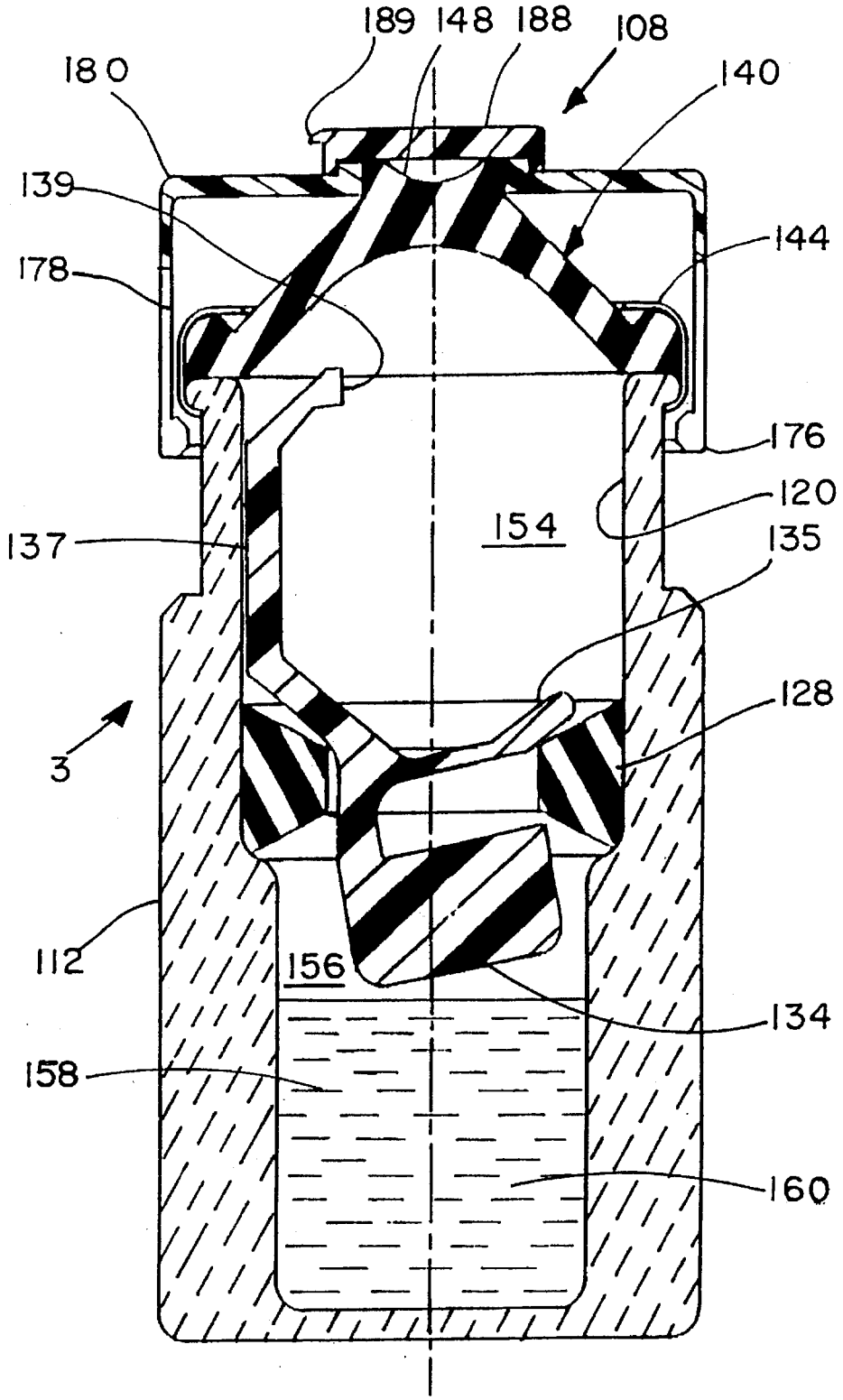
FIG. 10 is a view similar to that of FIG. 9 with the septum returned to its first, undeflected position and the pharmaceuticals mixed.

After mixing of the pharmaceuticals has been completed, the upper housing 172 is sprung back up the reduced diameter portion 177 of the container 112 to the positions shown in FIG. 10 by the action of the resilient elastomeric septum 140. The resilient flipper 135 rotates the upper portion 137 of extension 136 away from the center of the interior of the container 112 to a position against the upper interior wall 122. Thus the extension 136 is removed from the path of a needle which is inserted through the needle-pierceable region 148 of the septum 140. The extension and the plug are proportioned to continue to provide an opening for liquid flow when the vial is returned to this position so that the pharmaceutical may flow to the position illustrated in FIG. 11 suitable for filling a syringe. The septum 140 also has returned to its original convex position. This is a decided advantage because as is evident in FIG. 11, the liquid mixed pharmaceutical will flow to a position where substantially all of it may be captured in a syringe through a needle inserted in a conventional manner through needle pierceable region 148. The convex septum thus provides a well where the pharmaceutical may be captured and recovered by the syringe.

Figure 11:
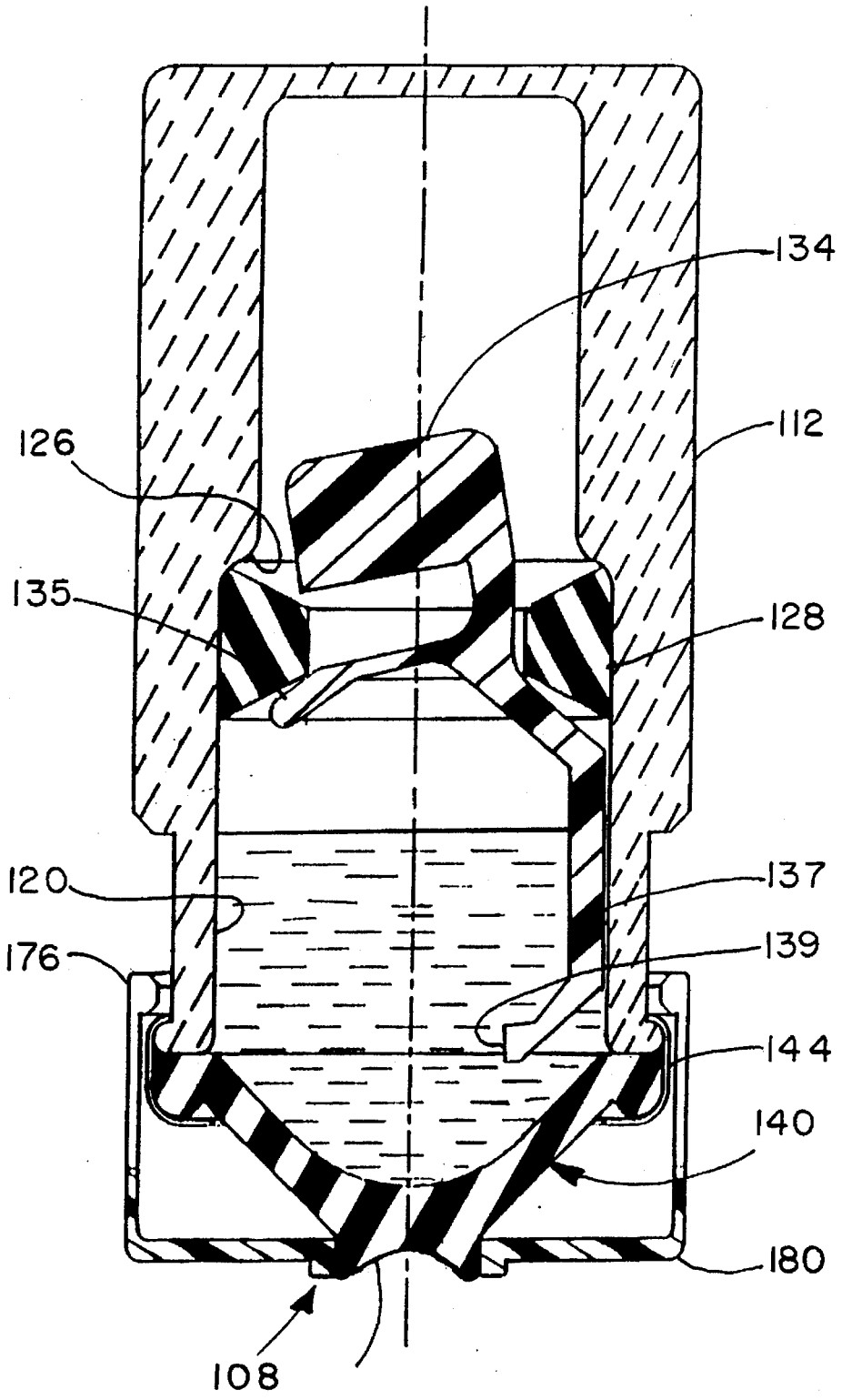
FIG. 11 is a view of the vial similar to that of FIG. 10 but inverted and ready for withdrawal of the mixed pharmaceutical.
Figure 12:
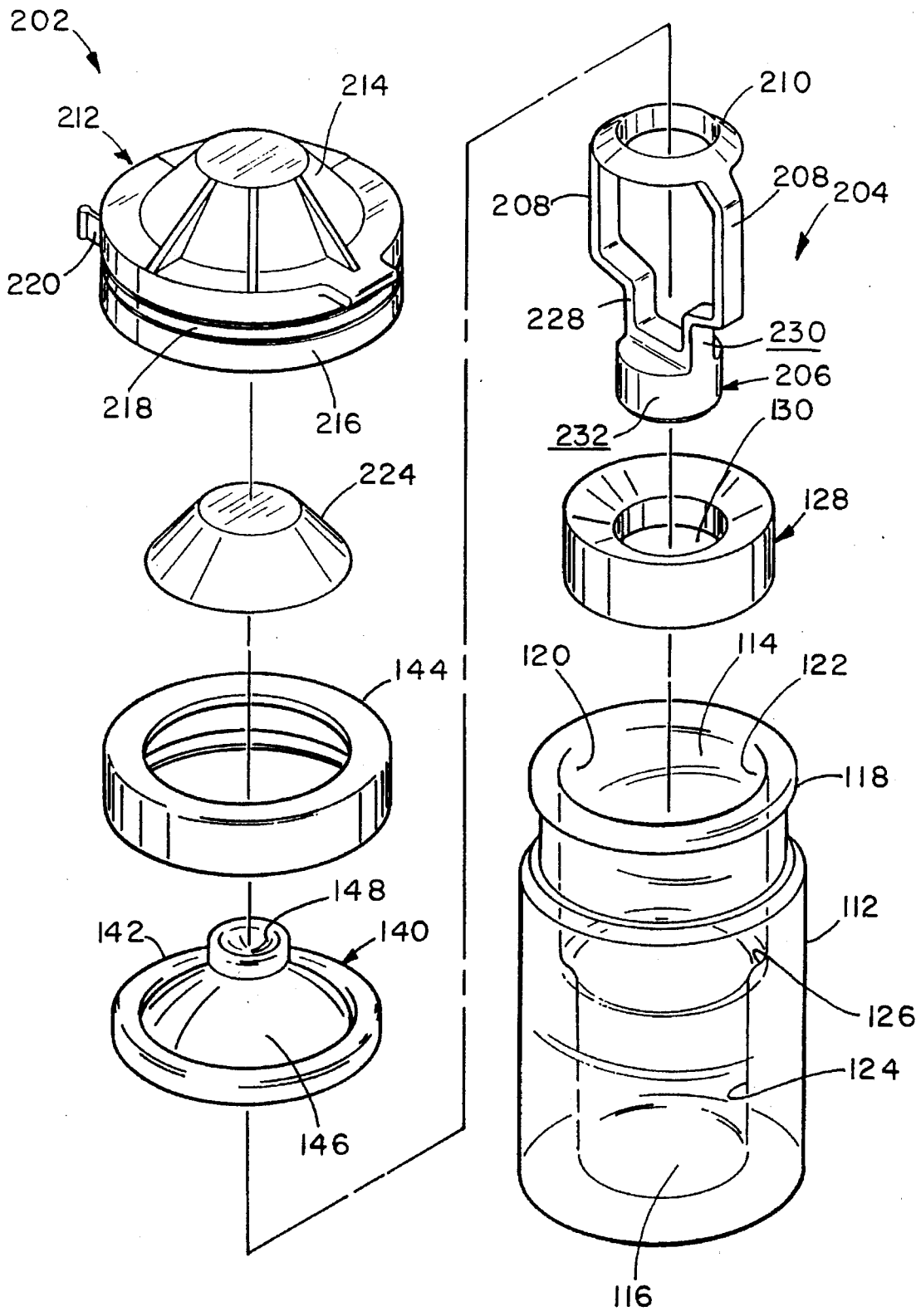
FIG. 12 is an exploded isometric view of the further vial made according to the invention.

A user could, if desired, dislodge plug 134 from hole 130 by simply pressing on needle-pierceable portion 148 of septum 140. This would drive plug extension 136 and thus plug 134 away from convex septum 140 until a crescent shaped opening is formed between the plug 134 and the sealing ring 128. This would permit, as shown in FIG. 9, the liquid pharmaceutical component 158 to flow into second interior region 156 and mix with second pharmaceutical component 160. Due in part to the natural resilience of septum 140, septum 140 returns to its normal, convex shape, see FIG. 10, once released by the user. Once components 158, 160 are suitably mixed, user can then invert vial 3 as shown in FIG. 11 and access the interior 152 using a needle cannula of a syringe to pierce portion 148 of septum 140 in a conventional manner. Since septum 140 returns to its pre-use condition, an overpressure within sealed interior 152 is eliminated.

FIGS. 12–14A illustrate a multi-pharmaceutical storage, mixing and dispensing vial 202. Dispensing vial 202 is similar to dispensing vial 3 of FIGS. 7–11 with like reference numerals referring to like components. That is, cup-shaped container 112, elastomeric seal ring 128 and septum 140 are the same as in the embodiment of FIG. 7.

Figure 13:
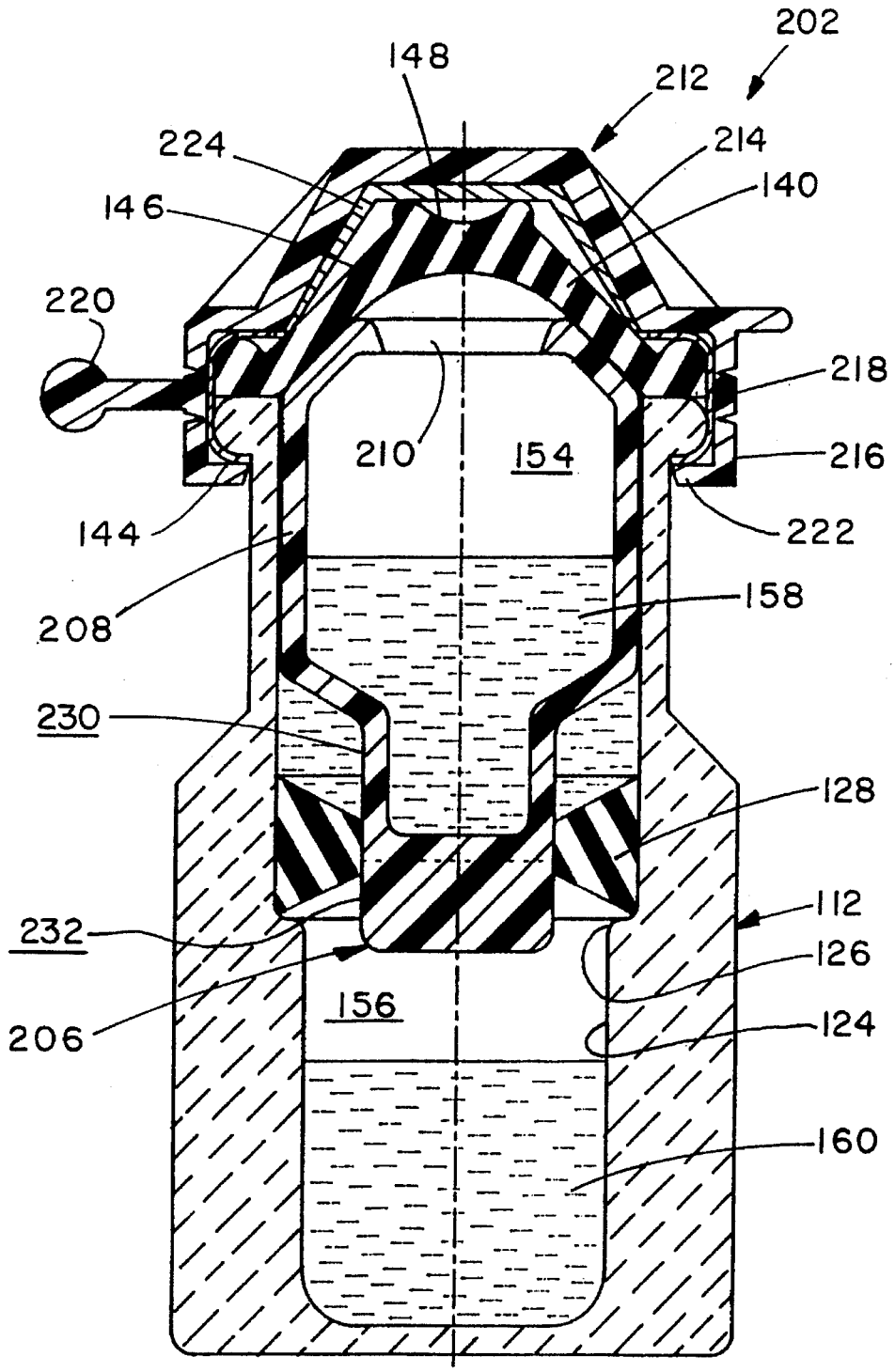
FIG. 13 is a cross-sectional view of the vial of FIG. 12 in the pre-use condition.

Vial 202 includes a barrier 204 made up of elastomeric seal ring 128 and a plug 206. Plug 206 has a pair of spaced-apart arms 208 which connect plug 206 to a ring 210. Arms 208 and ring 210 act as an extension of plug 206. Ring 210, as shown in FIGS. 13, lies adjacent septum 140 so that the defection of convex central portion 146 of septum 140 presses against ring 210 so to dislodge plug 206 from elastomeric seal ring 128 to assume the position of FIG. 14. Vial 202 also includes a tamper-evident cap 212 having an upper, domed portion 214 and a lower, ring portion 216 coupled together by a tear strip 218. Cap 212 is preferably a one piece molded product made of polypropylene. Tear strip 218 has a pull tab 220 to permit upper portion 214 to be separated from ring portion 216 as discussed below with reference to FIGS. 14 and 14A. Ring portion 216 has an internally directed rib 222 which engages beneath lip 118 of container 112 to maintain cap 212 on the container.

Figure 7:
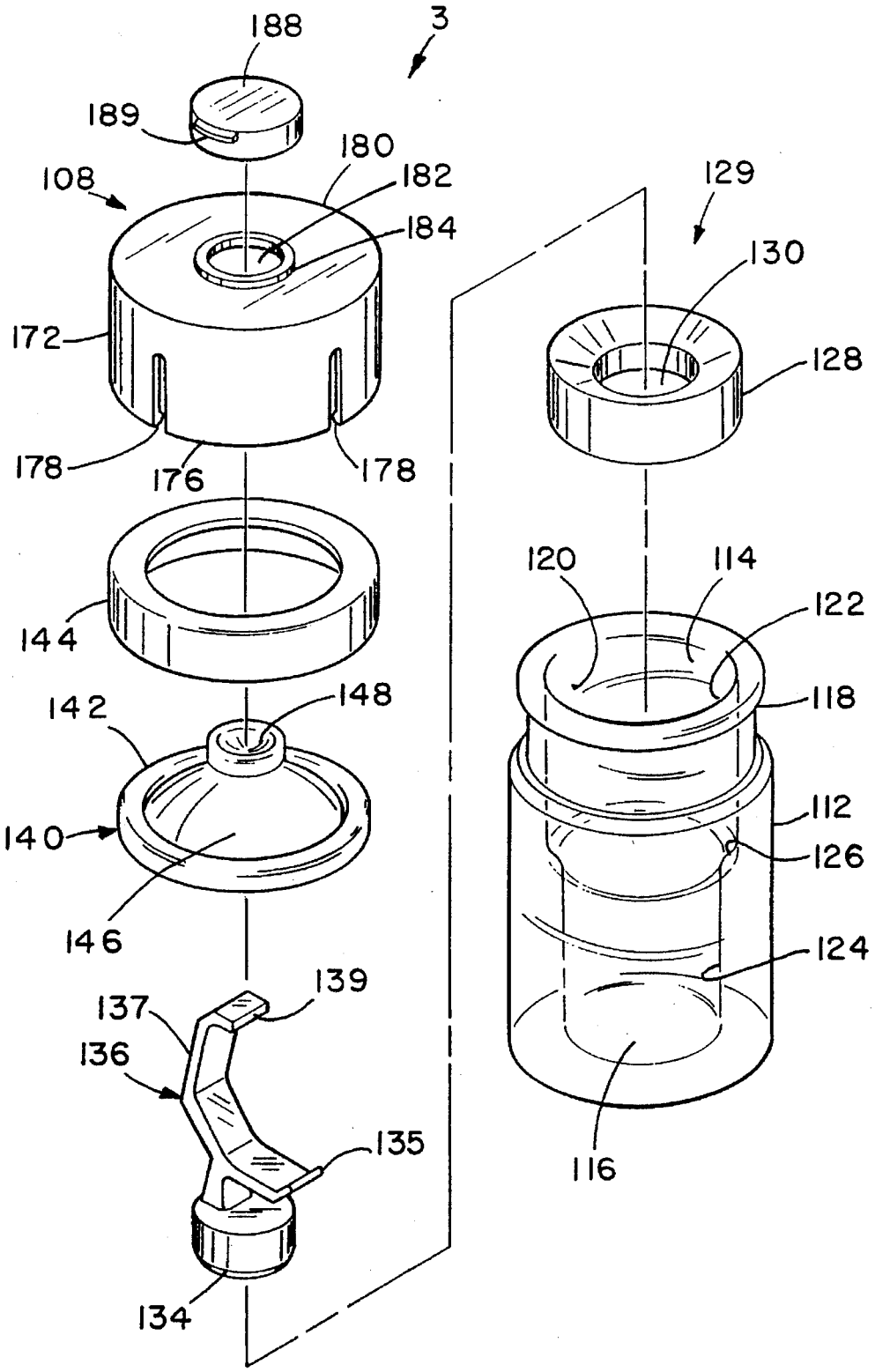
FIG. 7 is an exploded isometric view of the vial of FIG. 6.

The last component of vial 202 which is different from vial 3 of FIG. 7 is needle shield 224, typically made of aluminum. The needle shield 224 is press fit into the interior of upper portion 214 of cap 212. The use of needle shield 224 helps to protect against unauthorized access to the contents of container 112 prior removal of upper portion 214 of cap 212 by trying to pass a needle cannula through the cap, through septum 140 and into the container.

Figure 14:
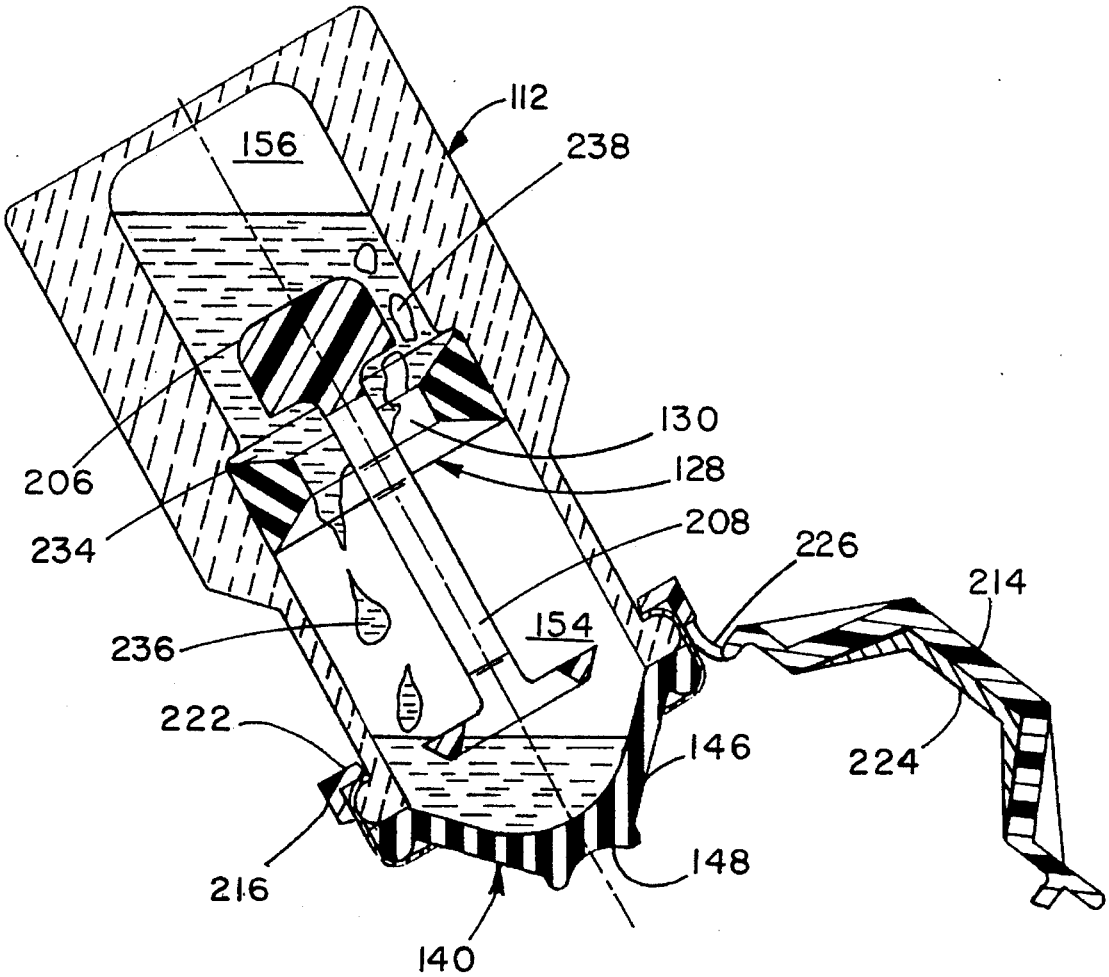
FIG. 14 is a cross-sectional view of the vial of FIG. 13 after the tear strip has been removed, the septum has been depressed and released and the vial has been partially inverted to permit the pharmaceutical components to mix.
Figure 14A:
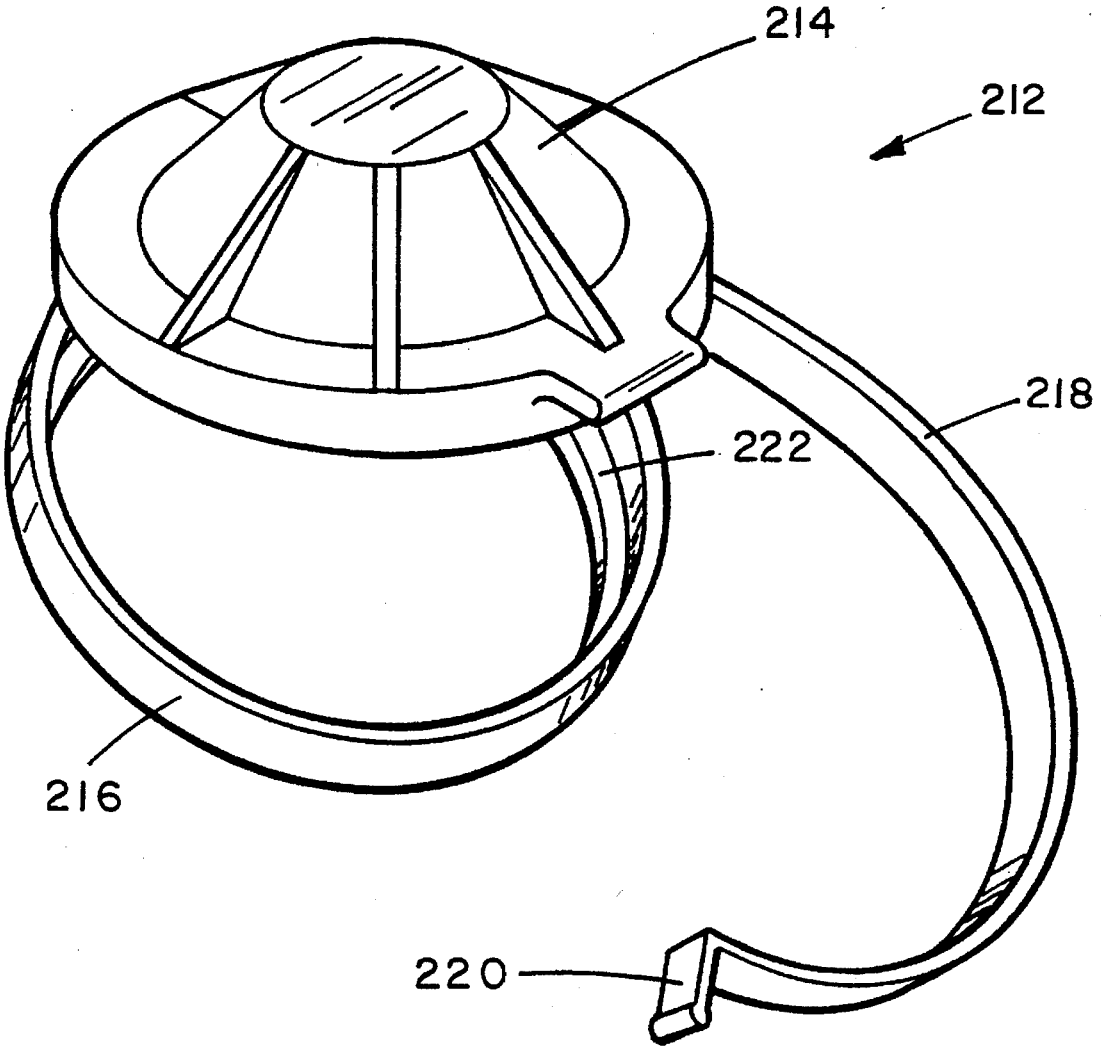
FIG. 14A is an isometric view illustrating the cap after removal of the tear strip.

In use, the user grasps pull tab 220 and pulls it around the periphery of cap 212 thus freeing upper portion 214 from lower ring portion 216 as shown in FIGS. 14 and 14A. It should be noted that pull tab 220, in the preferred embodiment, does not completely separate from either upper or lower portions 214, 216 so that both the pull tab and the upper portion remain secured to lower portion 216 by a hinge-like connection 226. If desired, tear strip 218 could be made to completely separate upper portion 214 from lower ring portion 216. Also, only tear strip 218 can be made to separate. Also, upper and lower portions 214, 216 could be made so that after the removal tear strip 218, the upper and lower portions could be once again secured to one another, such a through a snap fit or a threaded engagement.

Access to septum 140 is now provided the user. The user then presses against cup-shaped, needle pierceable portion 148 forcing convex central portion 146 of septum 140 against ring 210 thus partially dislodging plug 206 from hole 130 formed in elastomeric sealing ring 128. Distal portions 228 of arms 208 have outer surfaces 230 coplanar with the outer surface 232 of plug 206 and thus act as plug extensions. In this way plug 206 is only partially dislodged from ring 128 to create a generally annular gap 234 having a width of about 1 to about 4 millimeters. Note that the size of gap 234 is determined in large part by the diameter and the circumferential length of the gap and by the viscosity of the pharmaceutical component which is to flow through the breached barrier 204. When using saline or distilled water as the liquid component which is to pass through linear gap 234, a gap of about 1 to 2 millimeter has proven successful to create a desired bubbling or glugging action. As shown in FIG. 14, this action preferably takes place with vial 202 partially but not completely inverted. Drops 236 of second pharmaceutical component 160 fall into first pharmaceutical component 158 while bubbles 238 pass upwardly through gap 234 into second pharmaceutical component 160. After this initial passage and mixture, vial 2 can be inverted several more times to ensure proper mixing. However, the sizing of gap 234 preferably creates drops 236 and bubbles 238 to create a desired glugging action which encourages thorough but gentle mixing of the pharmaceutical components.

After the pharmaceutical components have been mixed, vial 202 is inverted completely from the position of FIG. 13, needle pierceable portion 148 is swabbed, such as with alcohol, and a needle cannula, not shown, is inserted through portion 148 and into the mixed pharmaceutical within pierced interior region 154. The configuration of ring 210 and arms 208 spaced widely apart helps to ensure that the tip of the needle cannula does not contact a solid surface while within interior region 154 to help prevent the needle cannula from being dulled prior to injection.

Figure 15:
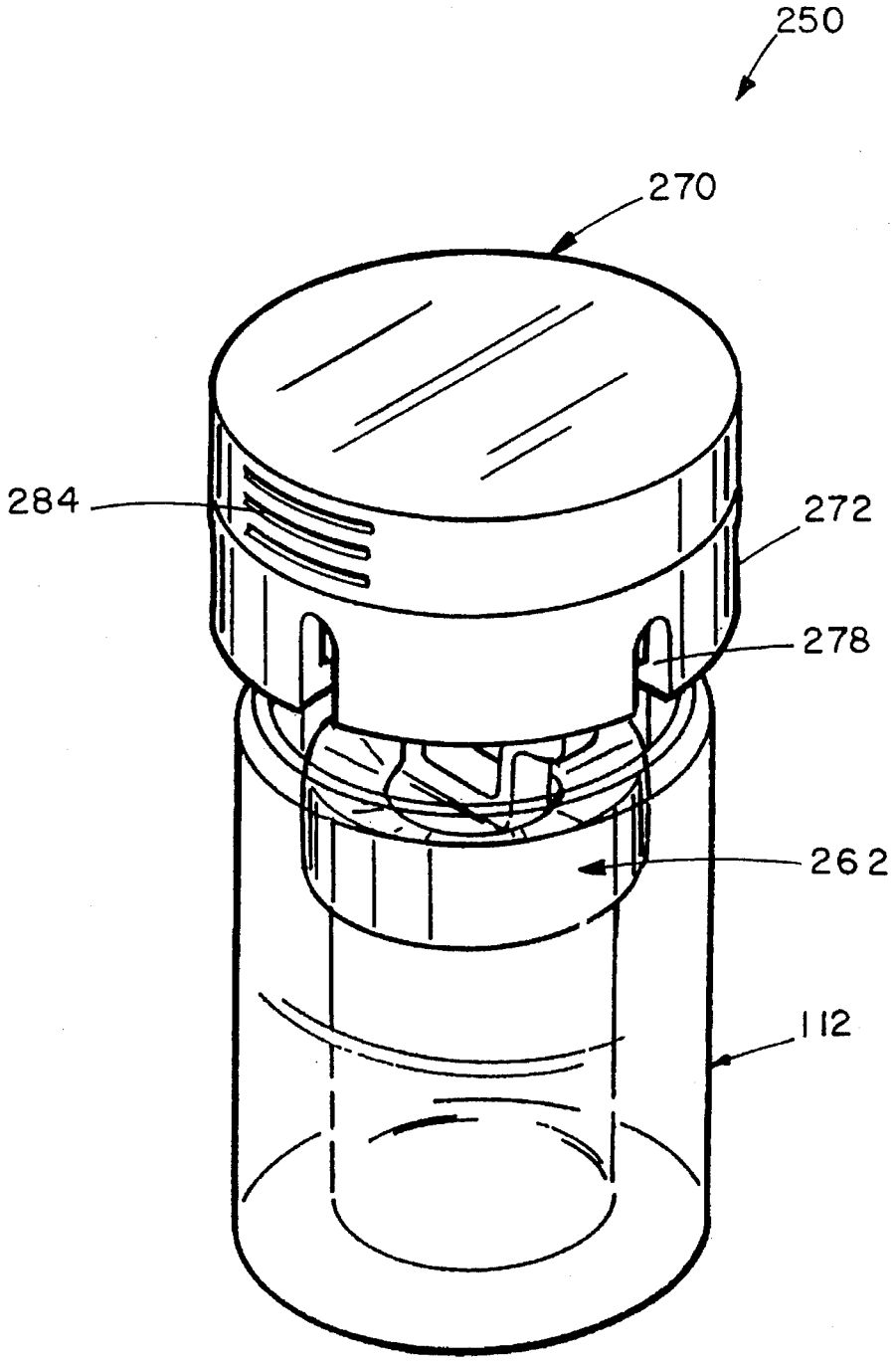
FIG. 15 is an isometric view illustrating a further vial made according to the invention shown in its assembled, as-shipped condition.
Figure 16:
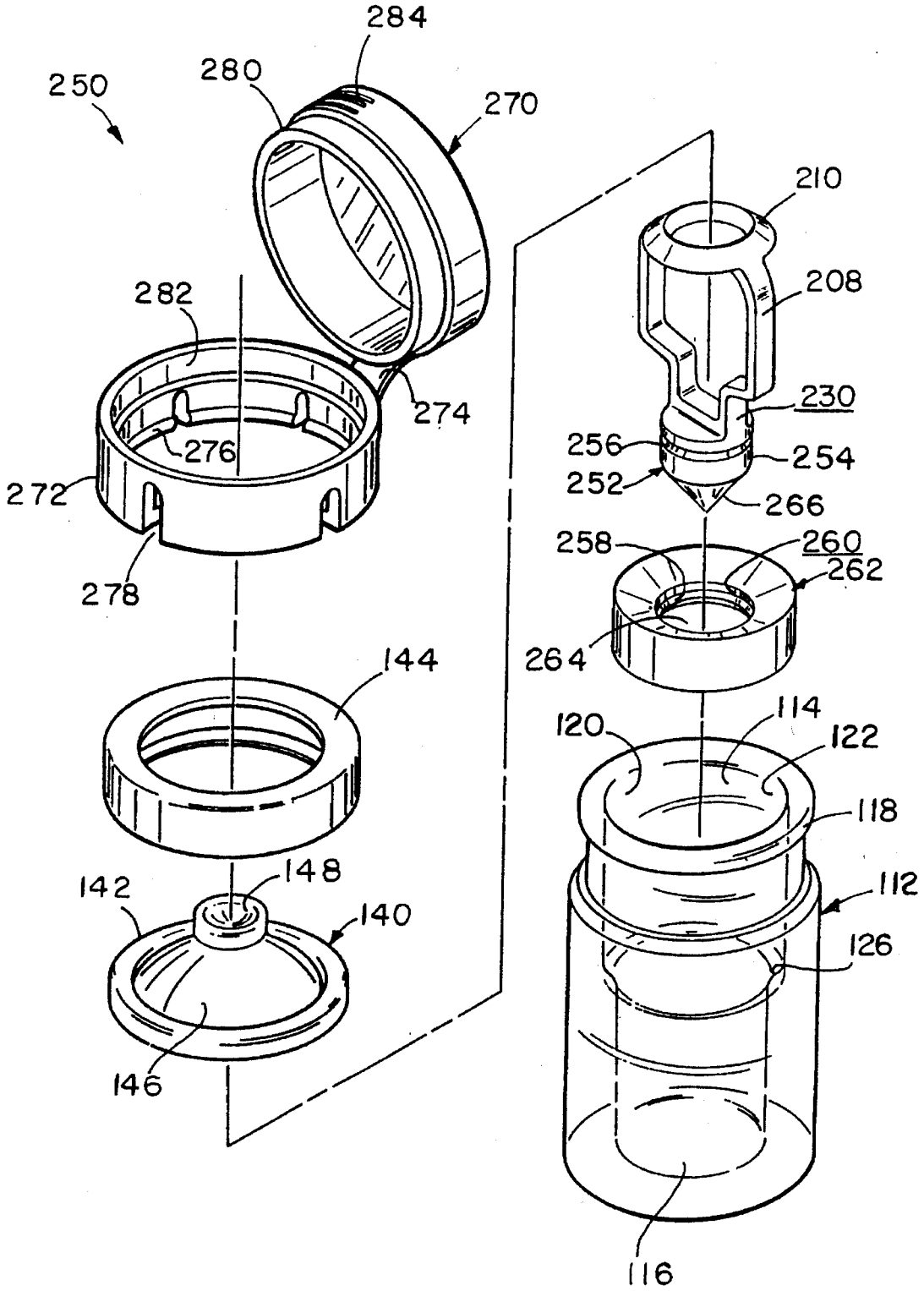
FIG. 16 is an exploded isometric view of the vial of FIG. 15.
Figure 17:
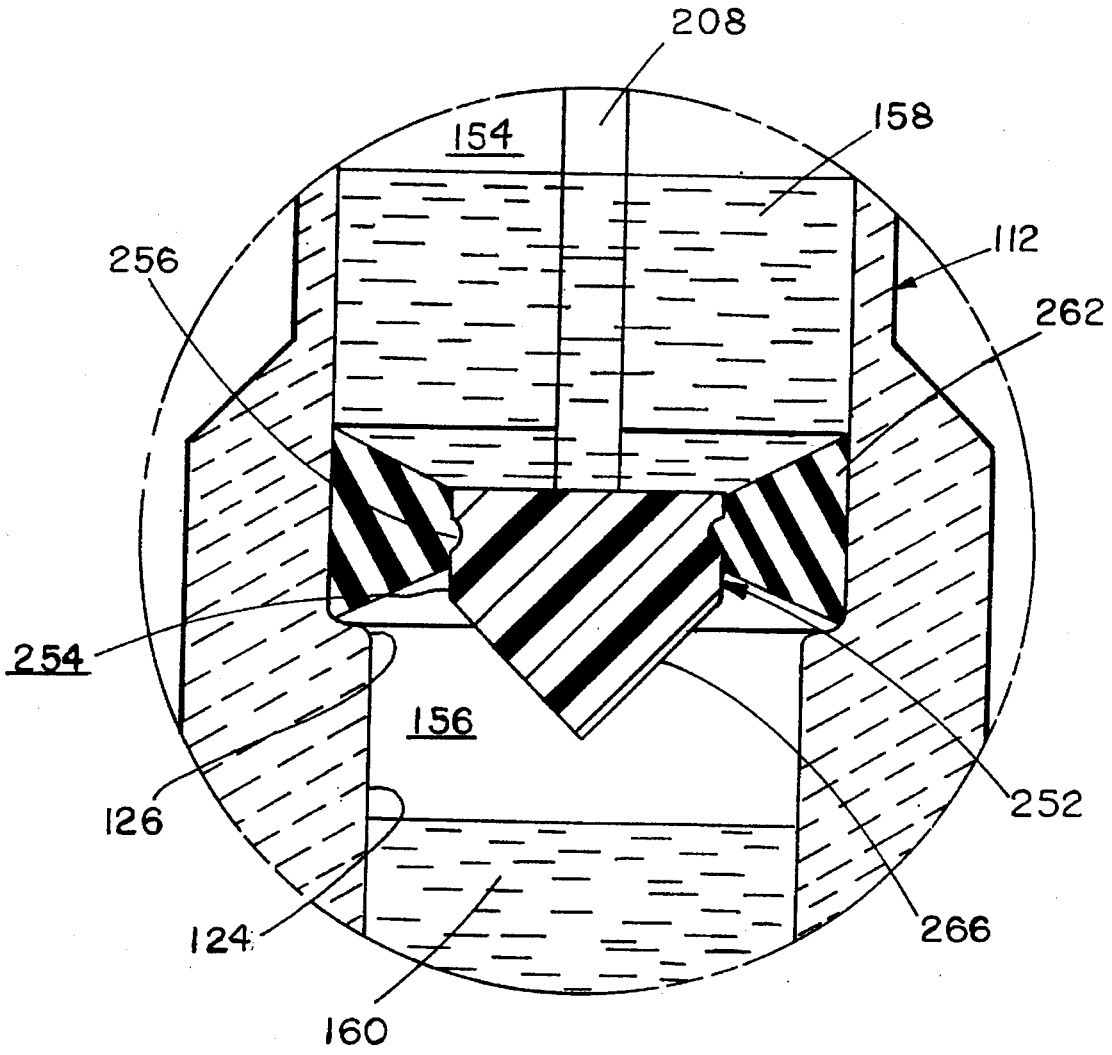
FIG. 17 is an enlarged cross-sectional view of the central portion of the vial of FIG. 15 illustrating the barrier separating the two pharmaceutical components.

FIGS. 15–17 illustrate a vial 250 similar to vial 202 with like elements referred to with like reference numerals. In particular, retainer band 144, septum 140 and container 112 are the same. Plug 252 differs from plug 206 in that its external surface 254, while being generally cylindrical, has a ridge-like protrusion 256 sized to engage a complementary groove 258 formed in the internal surface 260 of elastomeric seal ring 262. Internal surface 260 defines a central hole 264 in which plug 252 is housed. Plug 252 also includes a tapered lowered end 266 which can help guide plug 252 into hole 264 during initial assembly.

Vial 250 also includes a cap 270 connected to a cap retaining band 272 by a tether 274. Tether 274, retaining band 272 and cap 270 are all preferably made from a single molded piece, typically polypropylene. Retaining band 272 has an inwardly extending lip 276 which engages beneath lip 118 of container 112. This engagement is accommodated by a number of axial slots 278 formed in band 272 which permit the distal end of the band to dilate as it passes over lip 118. Cap 270 also includes a reduced diameter portion 280 sized to fit snugly within a proximal region 282 of band 272. Cap 270 is preferably made thick enough to deter unauthorized needle access of interior 152 through the cap and septum 140. A metal safety shield could be used within cap 270 if desired.

To move cap 270 from the closed position of FIG. 15 to an open position as suggested in FIG. 16, the user typically grasps vial 202, places his or her thumb against raised ridges 284 and then pushes cap 270 upwardly to expose septum 140. After exposing septum 140, vial 250 can be used in substantially the same manner as vial 202.

The principles, preferred embodiments and modes of operation of the present invention have been described in the foregoing specification, However, the invention which is intended to be protected is not to be construed as limited to the particular embodiments disclosed. The embodiments are to be construed as illustrative rather than restrictive. Variations and changes may be made by others without departing from the spirit of the present invention. Accordingly, all such variations and changes which fall within the spirit and scope of the present invention as defined in the following claims are expressly intended to be embraced thereby.

What is claimed is:

1. A pharmaceutical storage, mixing and dispensing vial, for storing first and second pharmaceutical components, mixing the pharmaceutical components and then providing access to the mixed pharmaceutical by a needle cannula, at least one of the first and second pharmaceutical components being a liquid component, the vial comprising:

a container having an inner wall and an open end;

a needle-pierceable access member having an outer region secured to the open end of the container so to create a sealed interior defined by the inner wall and the access member, said access member being deflectable inwardly into said interior from a first position to a second position;

a barrier within said interior defining said interior into first and second interior regions housing the first and second pharmaceutical components;

the barrier including an elastomeric seal ring positioned at a fixed location against the inner wall and having an internal surface defining a central opening and a plug removably positioned within the central opening for movement between sealed and unsealed positions; and a mechanical element, physically coupling the access member and the plug, configured so that movement of the access member from the first position to the second position moves the plug from the sealed position to the unsealed position thereby fluid coupling the first and second interior regions, the mechanical element including first and second spaced-apart arms and a ring from which the arms extend, the ring positioned opposite the access member.

2. A pharmaceutical storage, mixing and dispensing vial, for storing first and second pharmaceutical components, mixing the pharmaceutical components and then providing access to the mixed pharmaceutical by a needle cannula, at least one of the first and second pharmaceutical components being a liquid component, the vial comprising:

a container having an inner wall and an open end;

a needle-pierceable seal movably mounted to the container at the open end so to seal the open end, the inner wall and the seal defining an interior, at least a portion of the seal movable into the interior from a first position to a second position;

a barrier within the interior separating the interior into first and second interior regions housing the first and second pharmaceutical components, said barrier comprising a seal ring, having a central opening, positioned adjacent said interior and a plug sealed in said central opening;

a mechanical coupling between the seal and the plug for unseating said plug to breach the barrier to fluidly couple the first and second interior regions upon movement of the seal from the first position to the second positio, the mechanical coupling including a ring and first and second spread-apart arms extending form the plug to the ring.

3. A pharmaceutical storage, mixing and dispensing vial, for storing first and second pharmaceutical components, mixing the pharmaceutical components and then providing access to the mixed pharmaceutical by a needle cannula, at least one of the first and second pharmaceutical components being a liquid component, the vial comprising:

a container having an inner wall and an open end;

a needle-pierceable access member having an outer region secured to the open end of the container so to create a sealed interior defined by the inner wall and the access member, said access member being deflectable inwardly into said interior from a first position to a second position;

a barrier within said interior defining said interior into first and second interior regions housing the first and second pharmaceutical components;

means for breaching the barrier so to fluidly couple the first and second interior regions upon movement of the access member from the first position to the second position so the first and second pharmaceutical components mix to create the mixed pharmaceutical;

a tamper-evident cap mounted over the upper end of the container and covering the access member, the cap including a user-pullable tear strip;

a lower housing, the cap and the lower housing enclosing the container; and the cap and lower housing including mating cam sections which drive the cap between the first and second axial positions.

4. A pharmaceutical storage, mixing and dispensing vial, for storing first and second pharmaceutical components, mixing the pharmaceutical components and then providing access to the mixed pharmaceutical by a needle cannula, at least one of the first and second pharmaceutical components being a liquid component, the vial comprising:

a container having an inner wall and an open end;

a needle-pierceable access member having an outer region secured to the open end of the container so to create a sealed interior defined by the inner wall and the access member, said access member being deflectable inwardly into said interior from a first position to a second position;

a barrier within said interior defining said interior into first and second interior regions housing the first and second pharmaceutical components;

means for breaching the barrier so to fluidly couple the first and second interior regions upon movement of the access member from the first position to the second position so the first and second pharmaceutical components mix to create the mixed pharmaceutical;

a cap mounted over the upper end of the container and covering the access member;

a lower housing, the cap and the lower housing enclosing the container; and the cap and lower housing including mating cam sections which drive the cap between the first and second axial positions.

5. A pharmaceutical storage, mixing and dispensing vial, for storing first and second pharmaceutical components, mixing the pharmaceutical components and then providing access to the mixed pharmaceutical by a needle cannula, at least one of the first and second pharmaceutical components being a liquid component, the vial comprising:

a container having an inner wall and an open end;

a needle-pierceable seal movably mounted to the container at the open end so to seal the open end, the inner wall and the seal defining an interior, at least a portion of the seal movable into the interior from a first position to a second position;

a barrier within the interior separating the interior into first and second interior regions housing the first and second pharmaceutical components, said barrier comprising a seal ring, having a central opening, positioned adjacent said interior and a plug sealed in said central opening;

a mechanical coupling between the seal and the plug for unseating said plug to breach the barrier to fluidly couple the first and second interior regions upon movement of the seal from the first position to the second position; and the mechanical coupling including means for unseating the plug so the plug forms a crescent shaped opening with said seal ring.

6. The vial of claim 2 wherein the container is a glass container.

7. The vial of claim 2 wherein the seal is an elastomeric septum.

8. The vial of claim 2 wherein the seal is convex.

9. The vial of claim 2 wherein the seal is a resilient member having a convex portion which naturally assumes the first position so that all the pharmaceutical components when mixed and the vial inverted may flow down into the convex portion of the seal.

10. The vial of claim 1 wherein the plug includes an external surface configured for mating engagement with the internal surface of the seal ring.

11. The vial of claim 10 wherein the internal and external surfaces are cylindrical surfaces.

12. The vial of claim 10 wherein the internal and external surfaces have mating groove and ridge portions respectively which engage one another when the plug is at the seal position.

13. The vial of claim 10 wherein the internal and external surfaces are generally cylindrical surfaces with said groove and ridge portions formed thereon.

14. The vial of claim 1 wherein the plug is made of a lubricous plastic material.

15. The vial of claim 1 wherein the plug remains mounted within the central opening at both the sealed and unsealed positions.

16. The vial of claim 1 wherein the mechanical element is a clawlike extension.

17. The vial of claim 2 wherein:

the mechanical coupling includes a hollow interior housing a third pharmaceutical component; and further comprising:

means for fluidly coupling the third pharmaceutical component with the first and second pharmaceutical components to create a second mixed pharmaceutical upon movement of the seal from the first position to the second position.

18. The vial of claim 4 wherein the cap is tethered to the container for movement between an access member covering position and an access member exposed position.

19. The vial of claim 4 wherein the cap is movably mounted over the upper end of the container, for movement between first and second axial positions corresponding to the first and second positions of the access member, so to shield the access member when in the first axial position.

20. The vial of claim 19 wherein the cap includes an axial drive element, the cap being rotatably mounted over the upper end of the container for movement between the first and second axial positions.

21. The vial of claim 4 wherein the cap include a needle cannula shield overlying the access member.

22. The vial of claim 21 further comprising means for moving the needle cannula shield away from the access member, so to expose the access member to a needle cannula, when the cap is moved from the first axial position to the second axial position.

23. The vial of claim 22 wherein the needle cannula shield includes a pin sized to engage the open end of the container as the cap moves towards the second axial position.

24. The vial of claim 23 wherein the cap includes an access member engagement element for deflecting the access member from the first position to the second position as the cap is moved from the first axial position to the second axial position.

25. The vial of claim 2 further comprising means for moving the seal back to the first position, whereby any pressurization produced within said interior by the movement of the seal from the first position to the second position is eliminated.

26. The vial of claim 2 wherein the seal has a convex portion and means for moving the seal back to the first position whereby all the mixed pharmaceutical will flow into the convex portion of said seal.

27. The vial of claim 2 wherein the plug includes an external surface configured for mating engagement with the internal surface of the seal ring.

28. The vial of claim 27 wherein the internal and external surfaces have mating groove and ridge portions respectively which engage one another when the plug is at the seal position.

29. The vial of claim 2 wherein the mechanical coupling is a clawlike extension of said plug.

30. The vial of claim 5 wherein said crescent shaped opening causes glugging of said liquid component as it flows through the opening.

31. The vial of claim 30 wherein the crescent shaped opening is between about 1.5 to 2.0 mm.

32. The vial of claim 2 wherein the seal ring and the plug define a gap within the barrier when the plug is unseated, said gap sized and shaped to cause glugging of said liquid component as it flows through said gap.

33. The vial of claim 32 wherein the gap is a generally annular gap sized between about 1 to 2 mm.

34. The vial of claim 2 further characterized in that said needle-pierceable seal is convex shaped whereby the mixed pharmaceutical will flow into the seal when the vial is inverted.

35. This vial of claim 29 wherein the clawlike extension of said plug is in a position removed from the path of a needle when inserted through the needle-pierceable seal.

* * * * *